US006732836B2

(12) United States Patent
Ono

(10) Patent No.: US 6,732,836 B2
(45) Date of Patent: May 11, 2004

(54) MOUNTING METHOD FOR A HANDRAIL IN A FRAME SCAFFOLDING

(76) Inventor: Tatsuo Ono, 1-chome, 10-ban, 1-go, Kakigara-cho, Nihonbashi, Chuo-ku, Tokyo (JP)

( * ) Notice: Subject to any disclaimer, the term of this patent is extended or adjusted under 35 U.S.C. 154(b) by 0 days.

(21) Appl. No.: 10/154,518

(22) Filed: May 23, 2002

(65) Prior Publication Data

US 2002/0179370 A1 Dec. 5, 2002

(30) Foreign Application Priority Data

May 31, 2001 (JP) ..... 2001-163884
Dec. 28, 2001 (JP) ..... 2001-399685

(51) Int. Cl.[7] ..... A47L 3/02; E04G 1/00; E04G 7/00

(52) U.S. Cl. ..... 182/113; 182/179.1; 182/178.5

(58) Field of Search ..... 182/113, 179.1, 182/106, 178.5, 178.3, 178.1, 222, 223; 52/637, 638, 651.1, 655.1, 656.9; 403/49, 246

(56) References Cited

U.S. PATENT DOCUMENTS 3,863,900 A * 2/1975 Dagiel et al. ..... 256/59
4,782,914 A * 11/1988 Nail ..... 182/113
5,145,030 A * 9/1992 Pavlescak et al. ..... 182/113
5,901,810 A * 5/1999 Krause ..... 182/178.5
6,422,345 B1 * 7/2002 Schworer ..... 182/179.1

* cited by examiner

*Primary Examiner*—Hugh B. Thompson, II
(74) *Attorney, Agent, or Firm*—McGlew and Tuttle, P.C.

(57) ABSTRACT

A mounting method for a handrail capable of mounting and removal. The method uses frame with fittings and a lateral member. The frames are spaced laterally with a scaffolding plate erected between the lateral frames. A handrail is erected between the fittings adjacent to each other laterally to constitute a scaffolding frame. A plurality of the scaffolding frames are assembled vertically. The handrail includes a pair of longitudinal struts opposed laterally, and a lateral handrail frame erected between the struts, the struts including a first mounting member mounted on the lateral member or the fittings, a second mounting member mounted on the fittings, and a third mounting member for receiving an end of the handrail frame. The method includes mounting one strut on the upper end of one of the fittings via the first and second mounting members on the scaffolding plate of the lower stage. One end of the handrail frame is mounted on the one strut via the third mounting member on the scaffolding plate of the lower stage. The other strut on the other end of the handrail frame is mounted via the third mounting member on the scaffolding plate of the lower stage. The other strut is raised while rotating the other end upward about one end of the handrail frame on the scaffolding plate of the lower stage. The other strut is mounted on the upper end of the other strut via the first and second mounting members on the scaffolding plate of the lower stage.

3 Claims, 30 Drawing Sheets

MOUNTING METHOD FOR A HANDRAIL IN A FRAME SCAFFOLDING

BACKGROUND OF THE INVENTION

The present invention relates to a mounting method for a handrail in a frame scaffolding as a scaffolding device or a timbering used in building fields and engineering works fields, and more particularly to a mounting method for a handrail suitable for use with as an advance handrail.

Generally, in the building field of building and engineering works field, the frame scaffolding used as a scaffolding device or a timbering is installed.

In the frame scaffolding, a plurality of frames comprising fittings and a lateral member are stood, a scaffolding plate is erected between the lateral members adjacent to each other, one or plural sets of scaffolding frames having a handrail comprising a longitudinal strut and a lateral handrail frame erected between fittings are constituted vertically. In this case, the frame scaffolding making use of a handrail as a connecter between fittings, as disclosed in, for example, Japanese Patent Application Laid-Open No. Hei 7 (1995)-279402, has been developed.

This handrail is constituted so that longitudinal rods on both sides, a horizontal handrail rod for connecting upper ends of both the longitudinal rods, a horizontal handrail rod for connecting an intermediaries of both the longitudinal rods, and three mounting hardwares provided at upper and lower positions of the longitudinal rod are formed integrally, and the handrail is connected as an advance handrail to the fittings through a mounting hardware.

According to the above-described conventional frame scaffolding, since the handrail is provided corresponding to the scaffolding plate between the fittings, safety is secured, but on the other hand, there are disadvantages as follows:

First, since both longitudinal rods and upper and lower handrail rods are molded integrally, the weight is heavy, and so, an operator performs detaching work while straightening his back to raise the handrail. Therefore, work for erecting the handrail between the fittings is difficult and troublesome. Sometimes, the mounting work cannot be done by a single operator, materially lowering work for mounting and removing the handrail.

Second, the handrail itself is large and bulky, which is inconvenient in carrying and storing, being placed under restriction in storing space.

Third, when, after the fittings are assembled, the integral and large handrail is mounted on the fittings, it is placed under restriction in space between the fittings so that the handrail cannot be changed in various directions, thus resulting in difficulty and troublesome to mount the handrail on the fittings.

Fourth, when the entire handrail is integrated as described above, the weight becomes heavy. So, for the purpose of making the weight as light as possible, the entirety is molded with material which is light and low in strength. Then, conversely, the entire strength becomes low, because of which the longitudinal rods are connected to the fittings making use of three upper and lower mounting hardwares. This results in complicated construction, and the detaching operation of the mounting hardwares also becomes troublesome.

SUMMARY OF THE INVENTION

It is therefore an object of the present invention to provide a mounting method for a handrail as an advance handrail capable of simply and smoothly mounting and removing relative to a frame comprising fittings and a lateral member, and of freely performing locating without being placed under restriction in an installing space.

For achieving the aforementioned object, according to the present invention, there is provided a means, in a frame scaffolding in which a plurality of frames comprising fittings and a lateral member are stood laterally, a scaffolding plate is erected between the lateral members, a handrail is erected between the fittings adjacent to each other laterally to constitute a scaffolding frame, and a plurality of the scaffolding frames are assembled vertically, said handrail comprising a pair of longitudinal struts opposed laterally, and a lateral handrail frame erected between the struts, said strut including a first mounting member mounted on the lateral member or the fittings, a second mounting member mounted on the fittings, and a third mounting member for receiving an end of the handrail frame, the means comprising the steps of: mounting the one strut on the upper end of one fittings through the first and second mounting members on the scaffolding plate of the lower stage; mounting one end of the handrail frame on the one strut through the third mounting member on the scaffolding plate of the lower stage; mounting the other strut on the other end of the handrail frame through the third mounting member on the scaffolding plate of the lower stage; raising the other strut while rotating the other end upward about one end of the handrail frame on the scaffolding plate of the lower stage; and mounting the other strut on the upper end of the other fittings through the first and second mounting members on the scaffolding plate of the lower stage.

In this case, preferably, the first mounting member comprises a bracket having a plate bent into a roughly ]-shape secured to the strut, a holding groove formed at the lower end of the bracket and engaged with the outer surface of the fittings and a projection opposed to the holding groove, and an engaging groove likewise formed at the lower end of the bracket and fitted in the upper surface of the lateral member. Further, a stop pin for mounting a baseboard or a slot, and a stopper for controlling upward slipping out of the baseboard may be provided on the outer surface of the bracket.

Further, in the above-described means, the first mounting member may comprise a support plate connected laterally to the strut, a holding groove formed on the side of the support plate and engaged with the outer surface of the fittings, a stop plate connected to the outer end of the support plate and having an engaging groove engaged with the upper surface of the lateral member, a guide provided on the stop plate, and a wedge inserted into the guide and opposed to the engaging groove.

Likewise, the first mounting member may comprise a support rod connected laterally to the intermediary of the strut, and a hook mounted downward to the end of the support rod and fitted in a socket on the side of the fittings.

Likewise, preferably, the second mounting member comprises a plate-like bracket mounted laterally on the strut, a holding groove formed on the outer surface of the bracket and engaged with the outer surface of the fittings, a guide provided on the outer end of the bracket, and a wedge inserted into the guide and opposed to the holding groove. Likewise, the second mounting member comprises a support rod connected laterally to the lower part of the strut, and a hook provided downward on the end of the support rod and fitted in a socket on the side of the fittings.

Further, preferably, the third mounting member comprises a stop pin provided laterally on the strut and fitted in a slot formed in the end of the handrail frame.

Likewise, there is provided another means, in a frame scaffolding in which a plurality of frames comprising fittings and a lateral member are stood laterally, a scaffolding plate is erected between the lateral members, a handrail is erected between the fittings adjacent to each other laterally to constitute a scaffolding frame, and a plurality of the scaffolding frames are assembled vertically, said handrail comprising a pair of longitudinal struts opposed laterally, and a lateral main rope erected between the struts, said strut including a first mounting member mounted on the lateral member or the fittings, a second mounting member mounted on the fittings and a main rope mounting member for mounting the main rope, the means comprising the steps of: inserting the main rope into the main rope mounting portion of the upper end of the strut on the scaffolding plate of the lower stage; mounting the one strut on the upper end of one fittings through the first and second mounting members on the scaffolding plate of the lower stage; and mounting the other strut on the upper end of the other fittings through the first and second mounting members on the scaffolding plate of the lower stage.

Further, there is provided another means, in a frame scaffolding in which a plurality of frames comprising fittings and a lateral member are stood laterally, a scaffolding plate is erected between the lateral members, a handrail is erected between the fittings adjacent to each other laterally to constitute a scaffolding frame, and a plurality of the scaffolding frames are assembled vertically, the handrail comprising a pair of longitudinal struts opposed laterally, an expansible lateral handrail frame rotatably erected between the struts, and a upper and lower pair of first and second mounting members provided downward of the struts, the means comprising the steps of: raising one strut while extending the handrail frame on the scaffolding plate of the lower stage; mounting the one strut on one fittings through the first and second mounting members; raising the other strut while shortening the handrail frame on the scaffolding plate of the lower stage; and mounting the other strut on the other fittings through the first and second mounting members.

BRIEF DESCRIPTION OF THE DRAWINGS

FIG. 27 (B) is a back view of the bracket.

FIG. 27 (C) is a cross sectional plan view of the bracket.

DETAILED DESCRIPTION OF PREFERRED EMBODIMENTS

Figure 1:
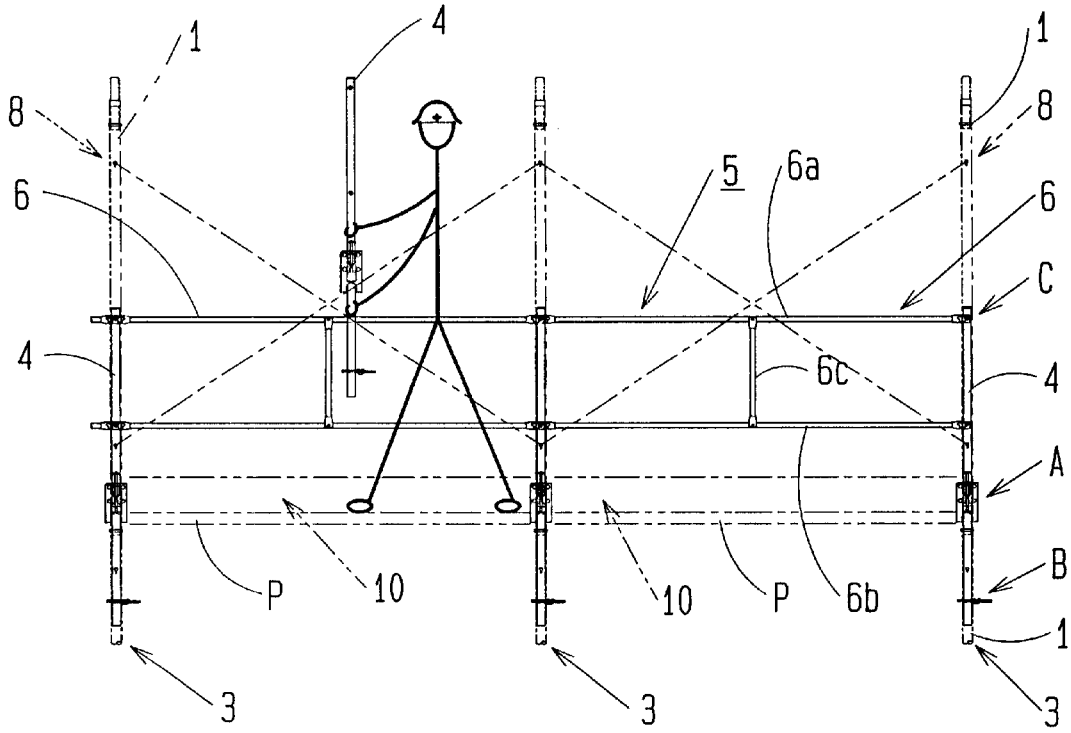
FIG. 1 is a front view schematically showing a frame scaffolding making use of a mounting device for a handrail according to a first embodiment of the present invention.

The preferred embodiments of the present invention will be explained hereinafter with reference to the drawings.

The mounting methods for a handrail according to the present invention include a first pattern shown in FIGS. 1 to 16, a second pattern shown in FIGS. 17 to 20 and 21, and a third pattern shown in FIGS. 22 to 31.

The basic constitution of a mounting device for a handrail used for the mounting method for a handrail according to the first pattern is that as shown in FIGS. 1 to 16, a plurality of frames 3 comprising fittings 1 and a lateral member 2 are stood in a lateral direction, a scaffolding plate P is erected between the lateral members 2, and a handrail 5 is erected between the fittings adjacent to each other laterally to constitute a scaffolding frame 8, which is used for a frame scaffolding in which a plurality of the scaffolding frames 8 are assembled in a vertical direction. The handrail 5 comprises a pair of longitudinal struts 4, 4 opposed in a lateral direction, and a lateral handrail frame 6 erected between the struts 4, 4. It is characterized in that the longitudinal strut 4 is provided with a first mounting member A mounted on the lateral member 2 or the fittings 1, a second mounting member B mounted on the lower part of the fittings 1, and a third mounting member C for receiving an end of the handrail frame 6, the longitudinal strut 4 is mounted on the frame 3 through the first and second mounting members A, B, and the handrail frame 6 is then mounted on the longitudinal strut 4 through the third mounting member C.

The embodiments will be explained hereinafter in further detail with reference to the drawings.

Figure 16:
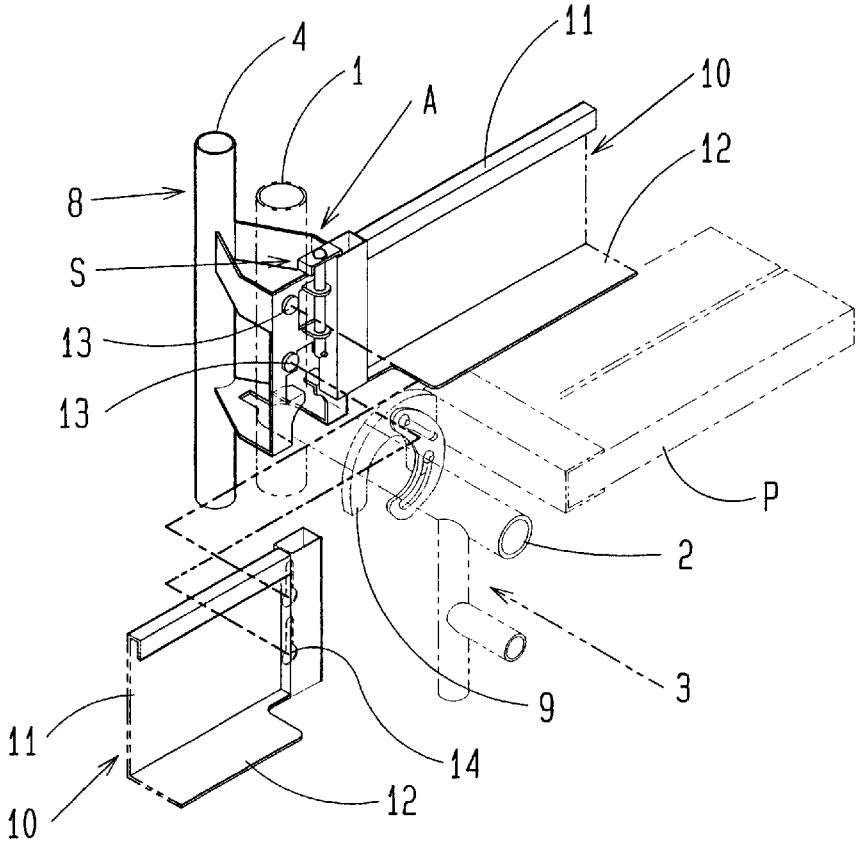
FIG. 16 is a perspective view of the state that a baseboard is mounted on the first mounting member.

A frame 3 comprises, as well known, a pair of front and rear longitudinal fittings 1, 1 stood in a longitudinal direction, and a lateral member 2 connected horizontally between the longitudinal members 1, 1, and as shown in FIGS. 1 and 16, scaffolding plates P are erected on the lateral member 2 in left and right lateral directions through a hook 9. Further, a handrail 5 is erected in a lateral direction between the left and right fittings 1 in the frame 3, and the handrail 5 is constituted by a pair of left and right longitudinal struts 4, 4, and a lateral handrail frame 6 erected detachably between the longitudinal struts 4, 4. The frame 3, the scaffolding plate P, and the handrail 5 constitute a scaffolding frame 8. One or plural scaffolding frames 8 are assembled in a lateral direction and in a vertical direction to constitute a frame scaffolding used as a scaffolding device or a timbering arranged in a building field or an engineering works field.

In the above-described frame scaffolding, the handrail 5 is provided to thereby to plan safety, but it is preferable to provide a baseboard 10 for blocking a gap formed on one side or on both sides of the scaffolding plate P. For example, as shown in FIG. 16, the baseboard 10 comprises a plate-like baseboard body 11 stood in a longitudinal direction and a gap blocking plate 12 provided horizontally at the lower part of the baseboard body 11, and the baseboard 10 arranged on the side of the scaffolding plate P is connected to the longitudinal strut 4 of the handrail 5 and the lateral member 2 of the frame 3 through the first mounting member A described later whereby the gap blocking plate 12 is placed in contact with the upper surface of the scaffolding plate P.

In this case, the first mounting member is provided, as will be described later, with a stop pin 13 and a stopper S, the baseboard 10 is provided a slot 14 formed on the end of the baseboard body 11, the baseboard body 11 is moved down while fitting the stop pin 13 into the slot 14 whereby the baseboard 10 is mounted by the stop pin 13 and the slot 14, and the baseboard 10 is prevented from slipping out by the stopper S.

Next, the mounting device used for carrying out the mounting method for the handrail according to the first pattern shown in FIGS. 1 to 16 will be explained in detail.

Figure 9:
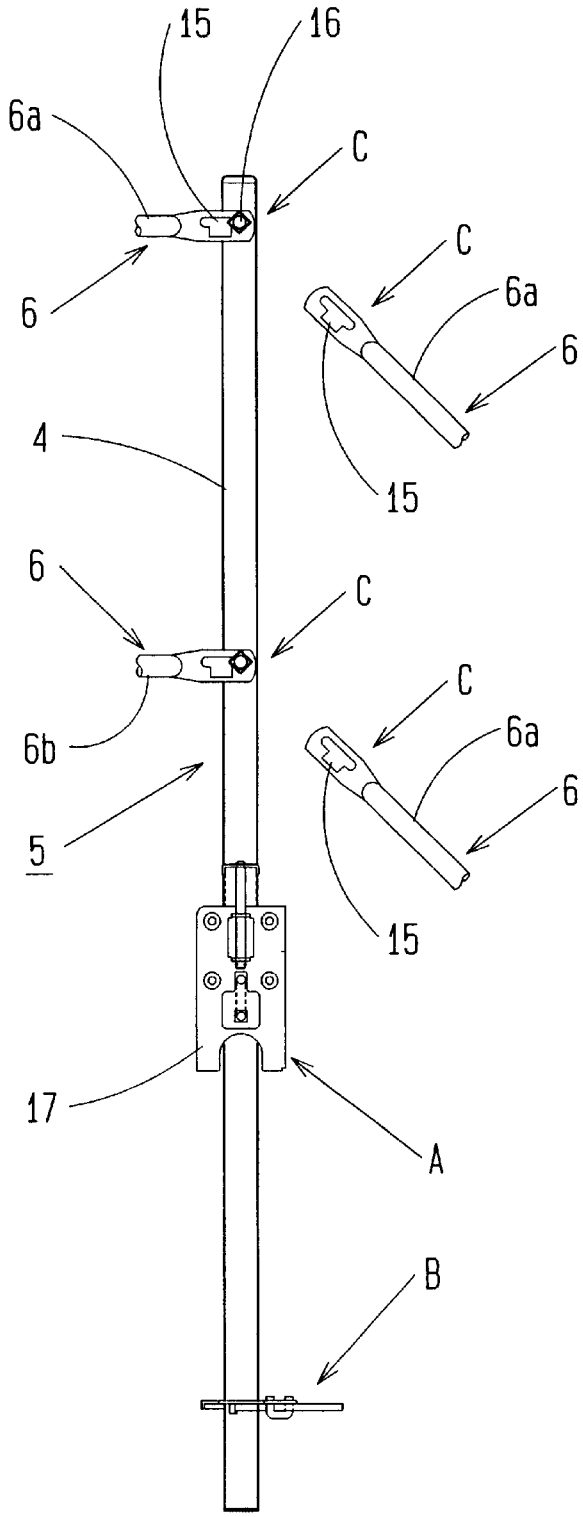
FIG. 9 is an enlarged front view of a strut for the handrail.
Figure 10:
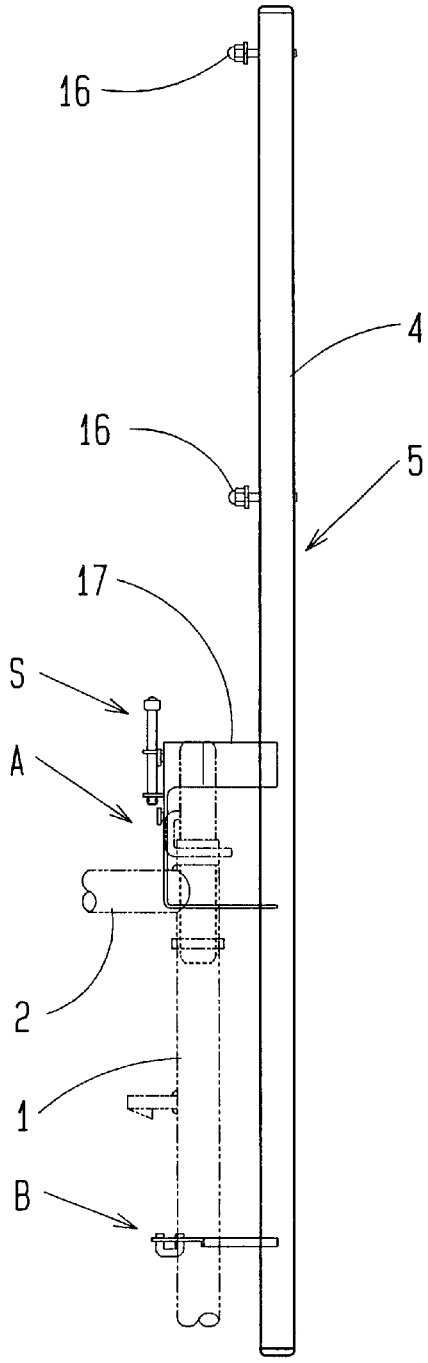
FIG. 10 is likewise an enlarged side view of the strut for the handrail.

The single handrail 5 according to this embodiment comprises, as shown in FIGS. 1, 9 and 10, a pair of left and right longitudinal struts 4, 4, a lateral handrail frame 6 connected detachably in a lateral direction between the longitudinal struts 4, 4. The handrail frame 6 may be formed from a single strut, but comprises two upper and lower struts 6*a*, 6*b*, and a connecting member 6*c* erected in a longitudinal direction between the struts 6*a*, 6*b* and having an end supported rotatably, and T-shaped slots 15 are formed on both ends of the strut 6. On the other hand, a pair of upper and lower stop pins 16, 16 are projected from the longitudinal strut 4, and the stop pin 16 constitutes the third mounting member C.

Further, the longitudinal strut 4 is provided nearly in the intermediate portion with the first mounting member A and in the lower part with the second mounting member B, the longitudinal strut 4 is connected to the lateral member 2 through the first mounting member A while wrapping the fittings 1, and the lower part of the longitudinal strut 4 is likewise connected to the fittings 1 through the second mounting member B.

The handrail frame 6 and a pair of longitudinal struts 4, 4 are separated in advance. In case where both of them are connected, first, one side of the handrail frame 6 is connected obliquely to the one strut 4 while fitting the slot 15 in the stop pin 16, and then the other end of the handrail frame 6 is connected to the other strut 4 through the stop pin 16 and the slot 15 while rotating the handrail 6 about the stop pin 16.

Figure 11:
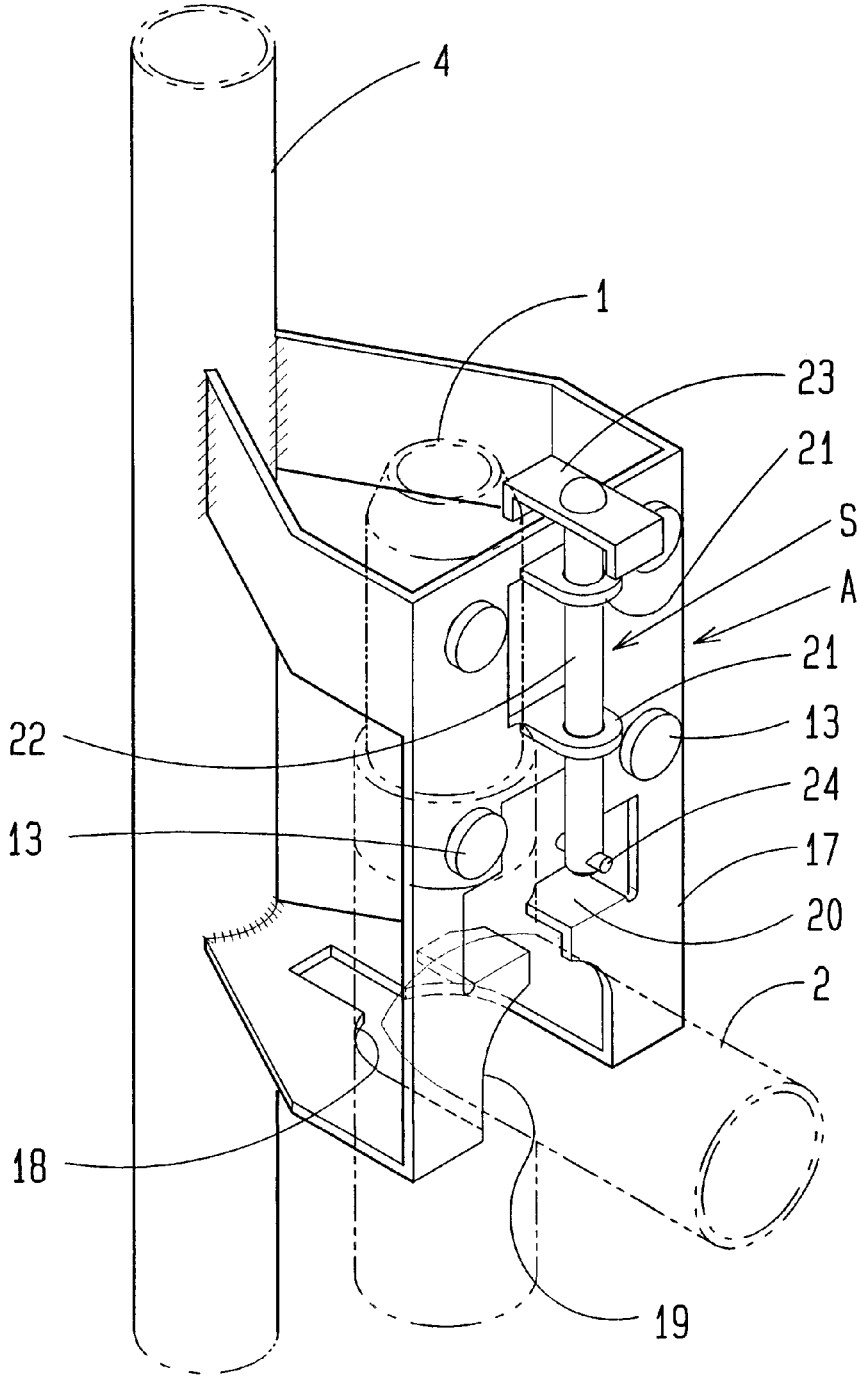
FIG. 11 is an enlarged perspective view of a first mounting member.

As shown in FIGS. 9 to 11, the first mounting member A comprises a bracket 17 formed by bending a plate into a nearly ⊐-shape secured to the longitudinal strut 4 by welding or the like, a holding groove 18 formed at the lower end of the bracket 17 and engaged with the outer surface of the fittings 1, an engaging groove 19 likewise formed at the lower end of the bracket 17 and fitted in the upper surface of the lateral member 2, and a projection 20 projected on the inner peripheral surface of the bracket 17 and opposed to the holding groove 18. The bracket 17 holds the fittings 1, and the fittings 1 is held by the holding groove 18 and the projection 20 to prevent occurrence of a rattle. Likewise, the bracket 17 is fitted in the lateral member 2 through the engaging groove 19 to prevent downward movement.

On the outer surface of the bracket 17 are provided the stop pin 13 for mounting the baseboard 10, and the stopper S for controlling upward slipping-out of the baseboard 10. The stop pin 13 may be provided on the side of the baseboard 10, and the bracket 17 may be formed with a slot in which is fitted the stop pin 13.

The stopper S comprises two upper and lower guide pieces 21, 21 stood on the surface of the bracket 17, a guide rod 22 inserted vertically movably and rotatably into the guide pieces 21, 21, a stop piece 23 provided on the upper end of the guide rod 22, and a stop pin 24 projected on the lower part of the guide rod 22, and as shown in FIG. 16, when the baseboard 10 is mounted through the stop pin 13, the stop piece 23 is rotated and connected to the upper end of the baseboard body 11 in the baseboard 10. Thereby, when the baseboard 10 is moved upward by the external force, the stop pin 24 comes in engagement with the lower guide piece 21 to prevent the baseboard 10 from slipping out upward.

Figure 12:
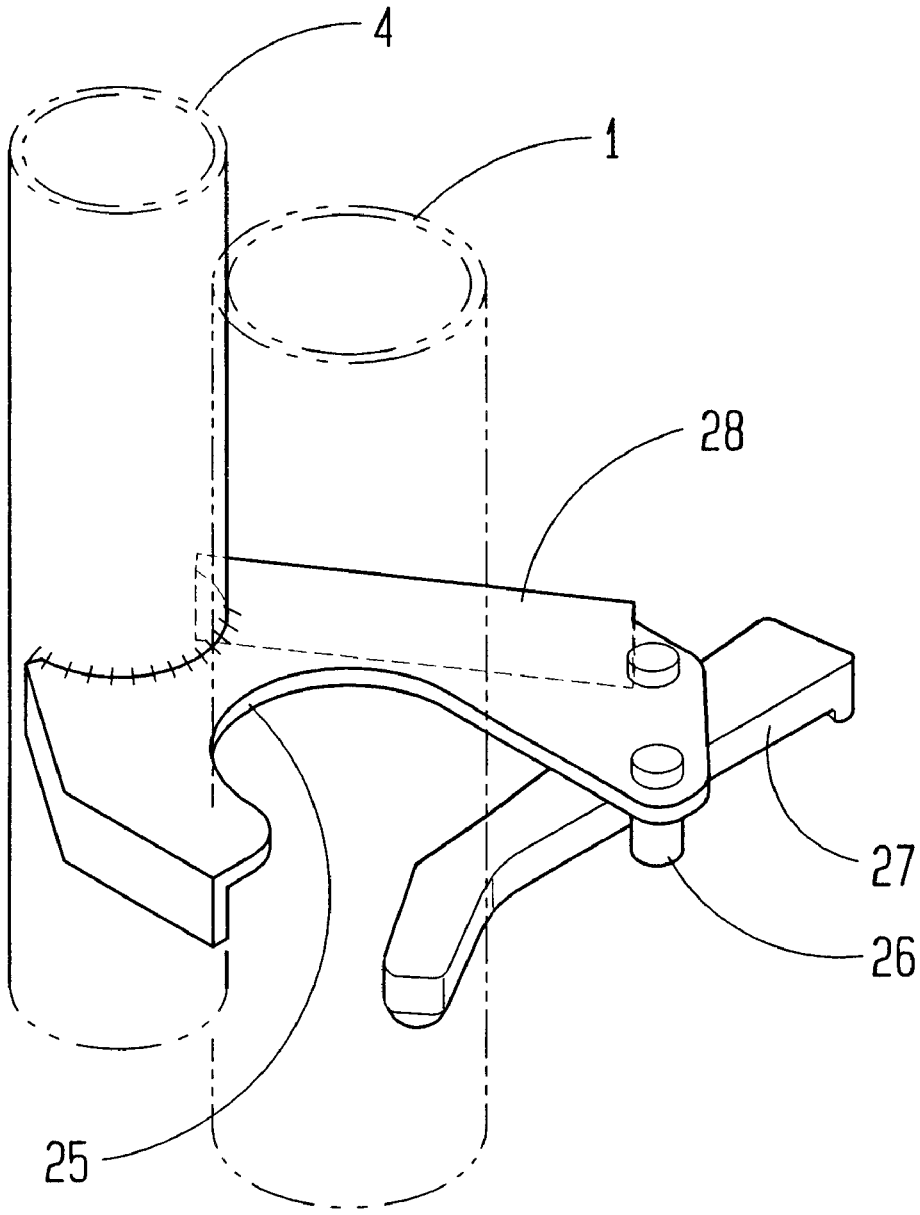
FIG. 12 is a perspective view of a second mounting member.

The projection 20 provided on the bracket 17 is formed by partly cutting the bracket 17 and bending the cut part internally, but a projecting member may be connected by welding or the like. The second mounting member B provided at the lower part of the longitudinal strut 4 comprises, as shown in FIG. 12, a plate-like bracket 28 mounted on the longitudinal strut 4 laterally by welding or the like, a holding groove 25 formed in the outer surface of the bracket 28 and engaged with the outer surface of the fittings 1, a guide 26 provided on the outer end of the bracket 28, and a wedge inserted into the guide 26 and opposed to the holding groove 25. Thereby, the bracket 28 is fitted to the fittings 1 through the holding groove 25, the wedge 27 is driven, the fittings 1 is held by the wedge 27 and the holding groove 25, and the longitudinal strut 4 is connected along the fittings 1.

Figure 13:
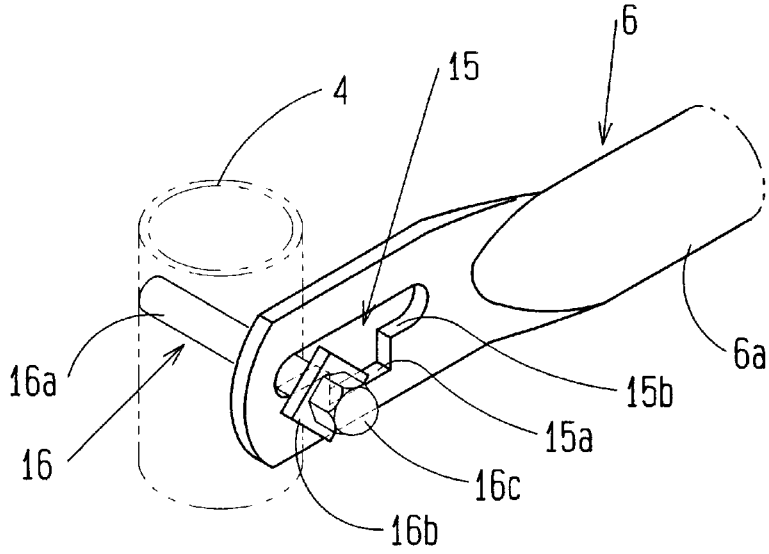
FIG. 13 is a perspective view of a third mounting member.
Figure 14:
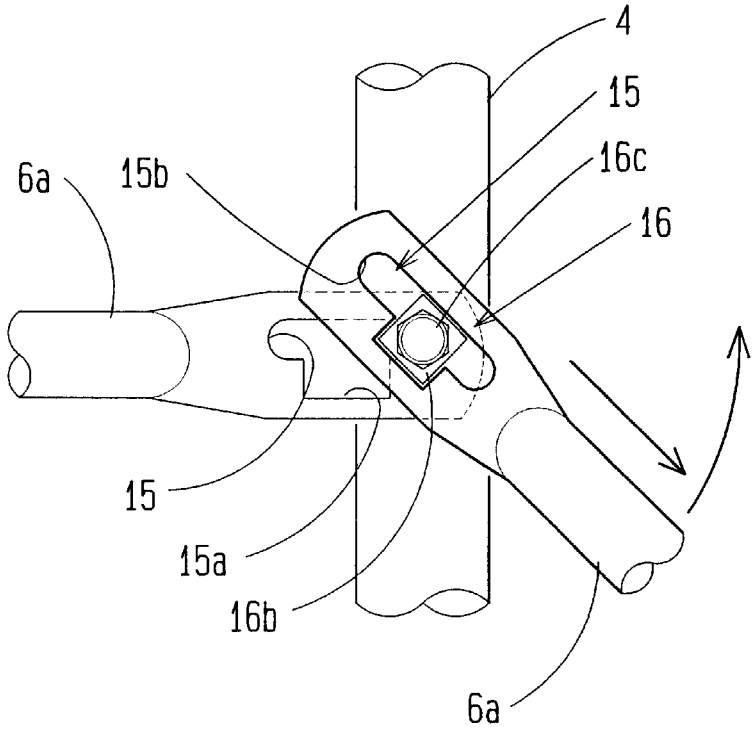
FIG. 14 is a front view of FIG. 13.
Figure 15:
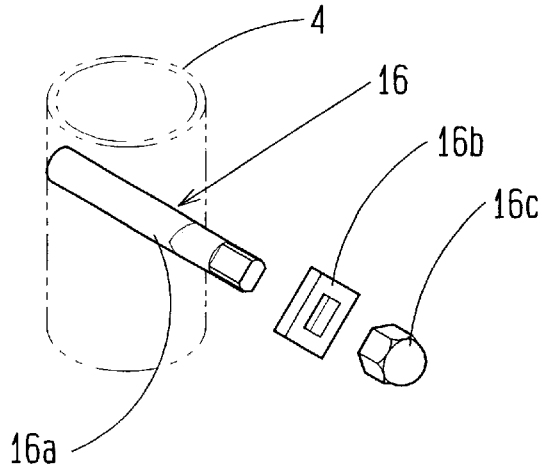
FIG. 15 is an exploded perspective view of the third mounting member.

As has been described above, the third mounting member C comprises the stop pin 16, but preferably, the stop pin 16 and the slot 15 in engagement therewith are formed into a construction shown in FIGS. 13 to 15.

The stop pin 16 shown in FIGS. 13 and 14 comprises a pin body 16*a*, a flange 16*b* secured to the end of the pin body 16*a*, and a nut 16*c*. In this case, the flange 16*b* is formed in a square shape, and moreover is set by being inclined by 45 degrees with respect to the axis of the longitudinal strut 4. The slot 15 is approximately equal to the width of the flange 16, and is constituted by a ⊐-shaped or U-shaped (in section) deep groove 15*a* and a laterally long groove 15*b*. The stop pin 16 is prevented from being slipped out by inserting the flange 16*b* through the deep groove 15*a* and afterward moving the pin body 16*a* on the side of the long groove 15*b*.

Incidentally, when the flange 16*b* is inserted into the slot 15, the handrail frame 6 is inclined by 45 degrees, and an angle of the slot 15 is adjusted to an angle of the flange 16*b*. Then, after the flange 16*b* has been inserted into the slot 15 and when the handrail frame 6 is rotated, the handrail frame 6 is not slipped out of the flange 16*b*. Further, as shown in another embodiment of FIG. 15, the flange 16*b* and the nut 16*c* may be connected detachably to the pin body 16*a*. In this case, after the handrail 5 has been mounted, the flange 16*b* and the nut 16*c* are removed, and the handrail frame 6 can be removed separately.

Next, the frame scaffolding using the mounting device for the handrail according to the method of the first pattern, particularly the mounting step for the handrail will be explained with reference to FIGS. 1 to 8.

Figure 2:
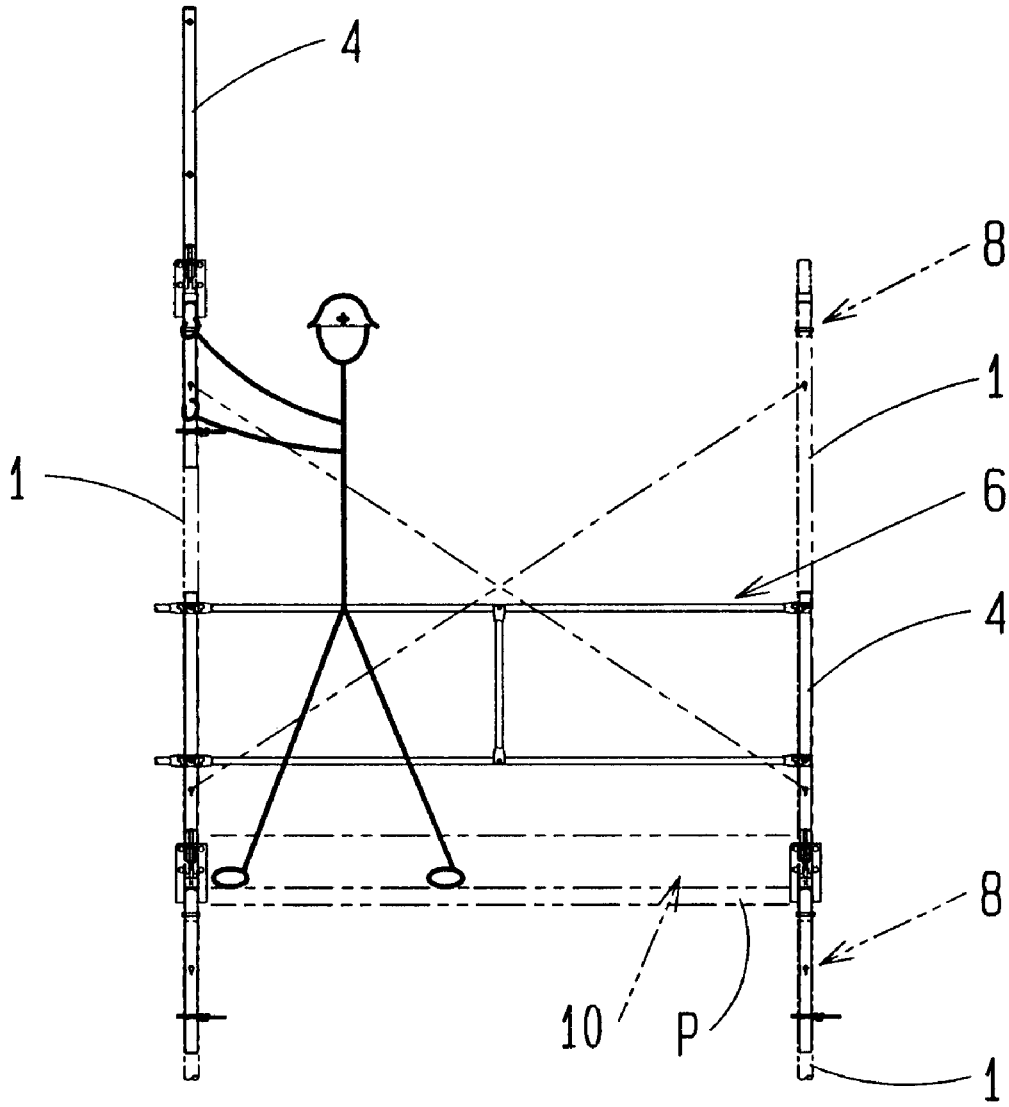
FIG. 2 is a front view of the frame scaffolding showing the mounting steps of the handrail.

FIGS. 1 and 2 show the initial state that the scaffolding frame 8 of the lower stage has been already assembled, and the other scaffolding frame 8 of the upper stage is mounted above the scaffolding frame 8. In this state, since the handrail 5 has been already installed above the scaffolding plate P of the lower stage, the fittings 1, 1 of the upper stage are connected to the fittings 1, 1 of the lower stage, as shown, while planning the safety by the handrail 5. Then, similarly, an operator on the scaffolding plate P of the lower stage connects one longitudinal strut 4 of the handrail 5 on the upper stage side to the fittings 1 through the first and second mounting devices A, B as shown while planning the safety by the handrail 5.

Figure 3:
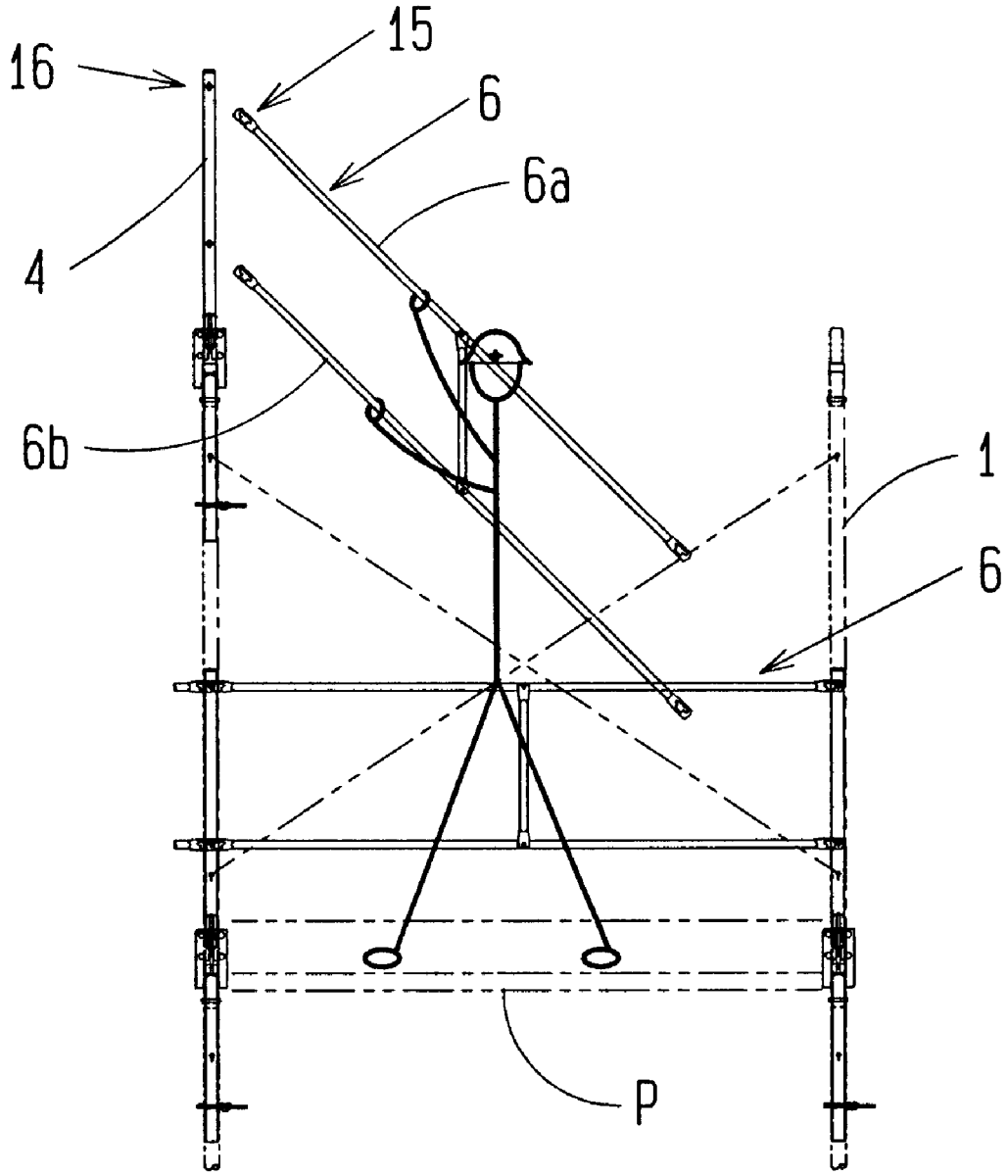
FIG. 3 is a front view of the frame scaffolding showing the mounting steps of the handrail.

Next, as shown in FIG. 3, the left side of the handrail frame 6 is slipped on and connected to the stop pin 16 of the left strut 4 through the slot 15.

Figure 4:
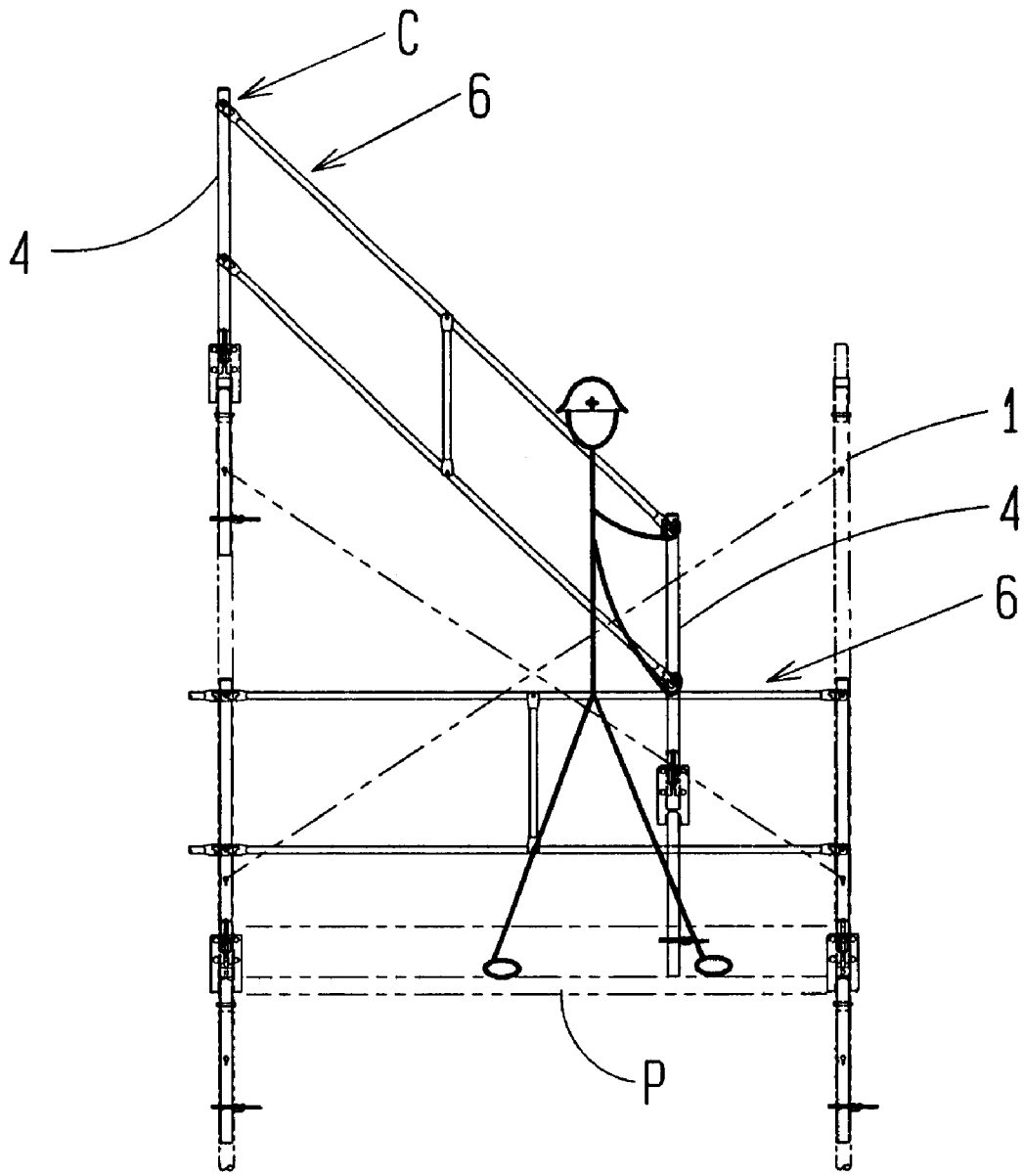
FIG. 4 is a front view of the frame scaffolding showing the mounting steps of the handrail.
Figure 5:
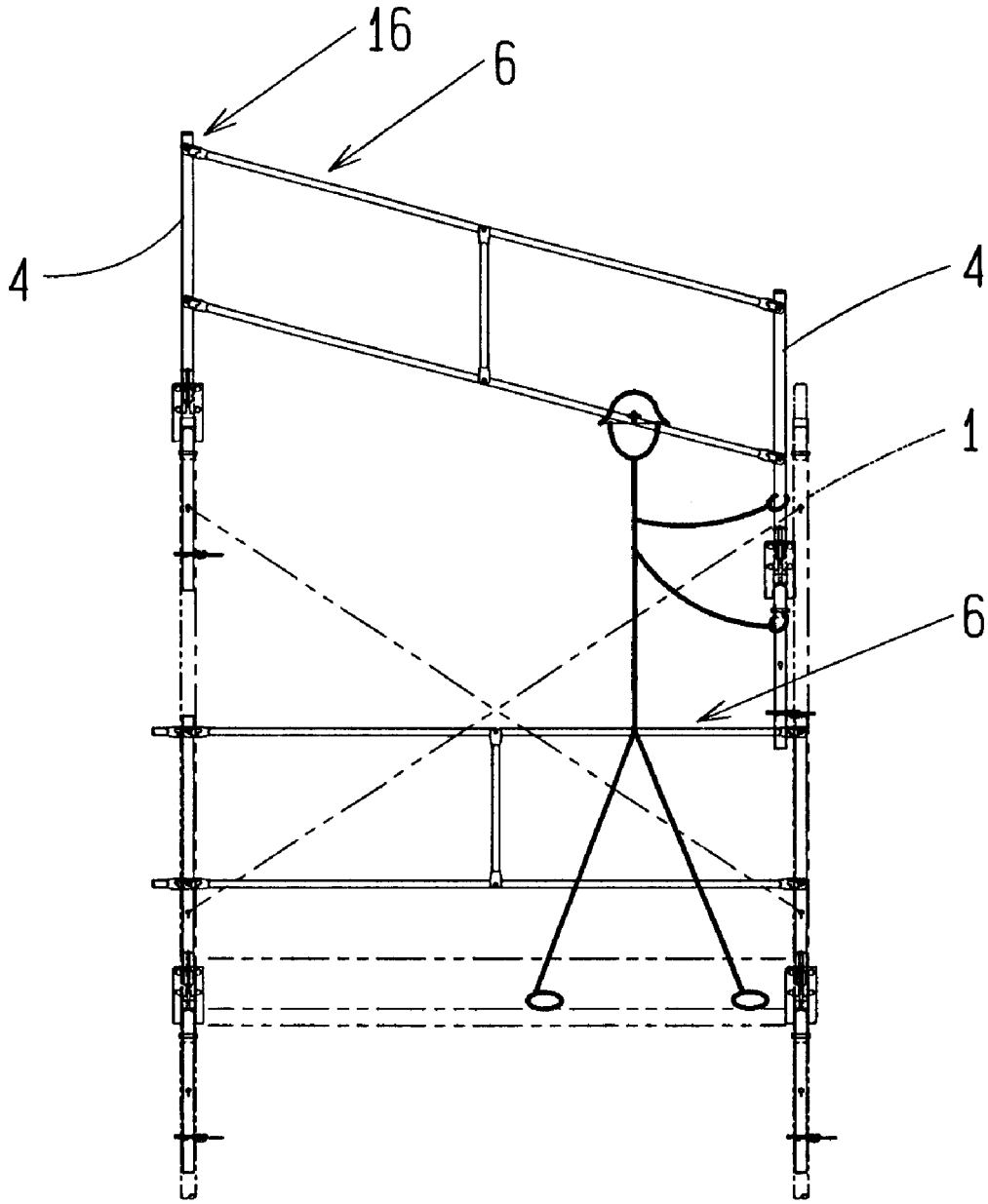
FIG. 5 is a front view of the frame scaffolding showing the mounting steps of the handrail.
Figure 6:
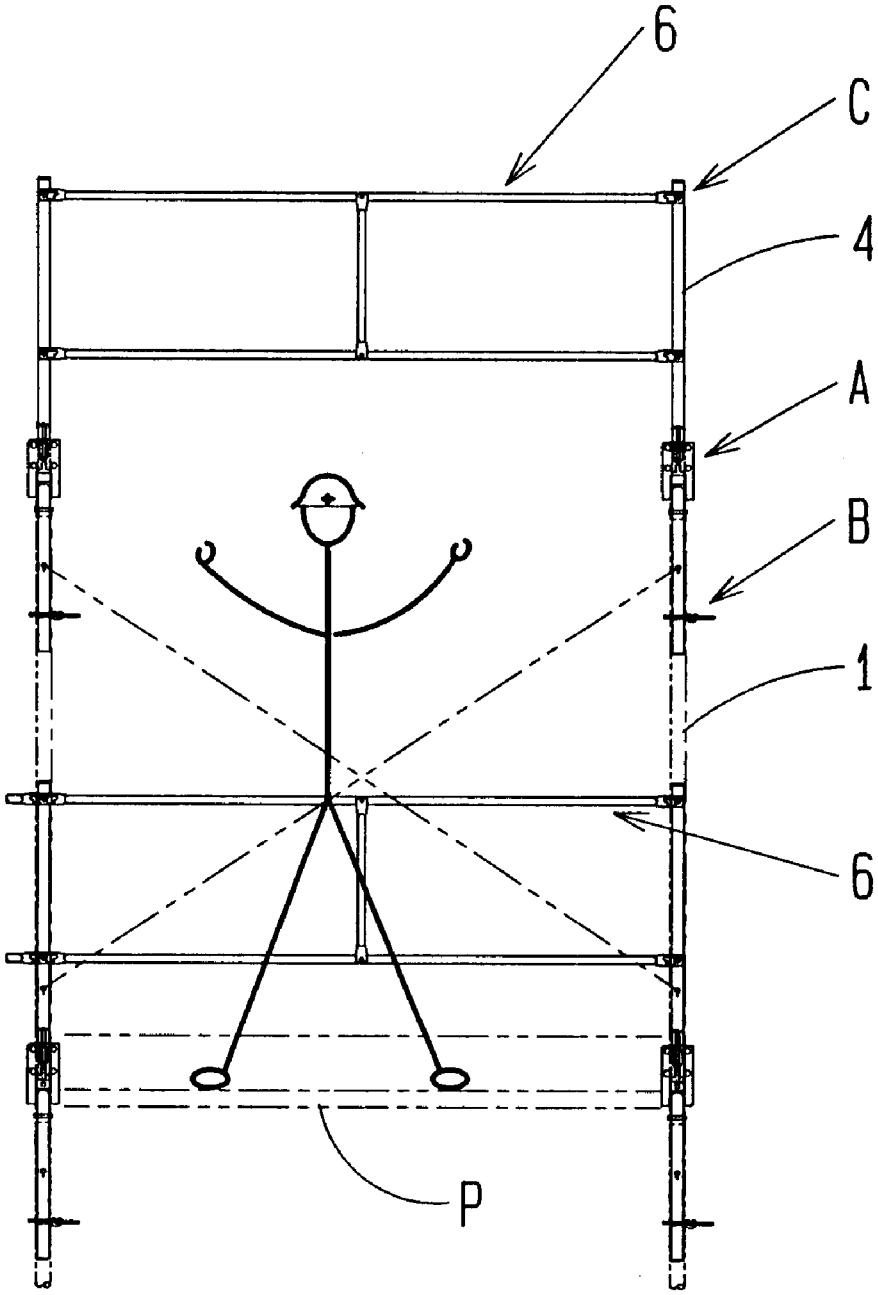
FIG. 6 is a front view of the frame scaffolding showing the mounting steps of the handrail.
Figure 7:
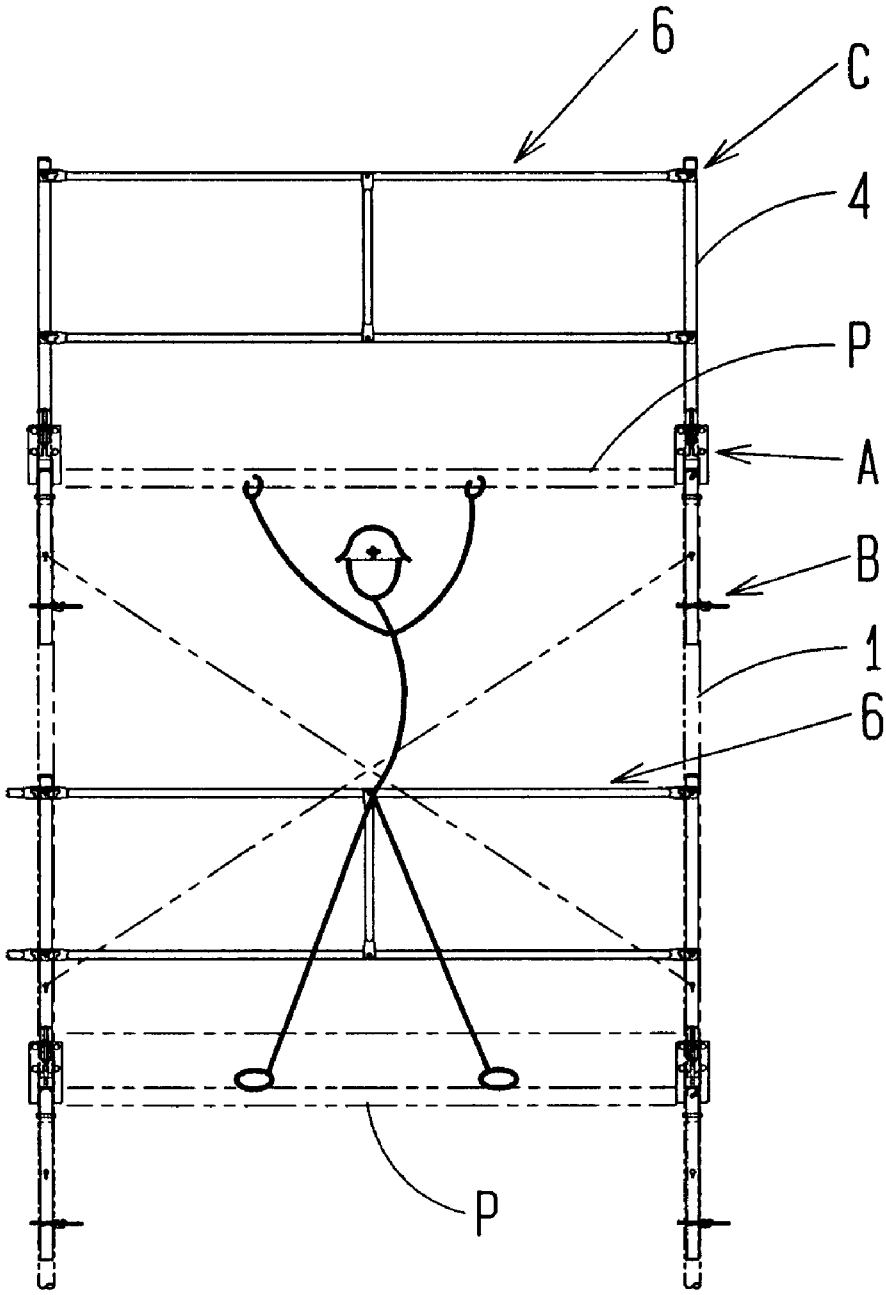
FIG. 7 is a front view of the frame scaffolding showing the mounting steps of the handrail.
Figure 8:
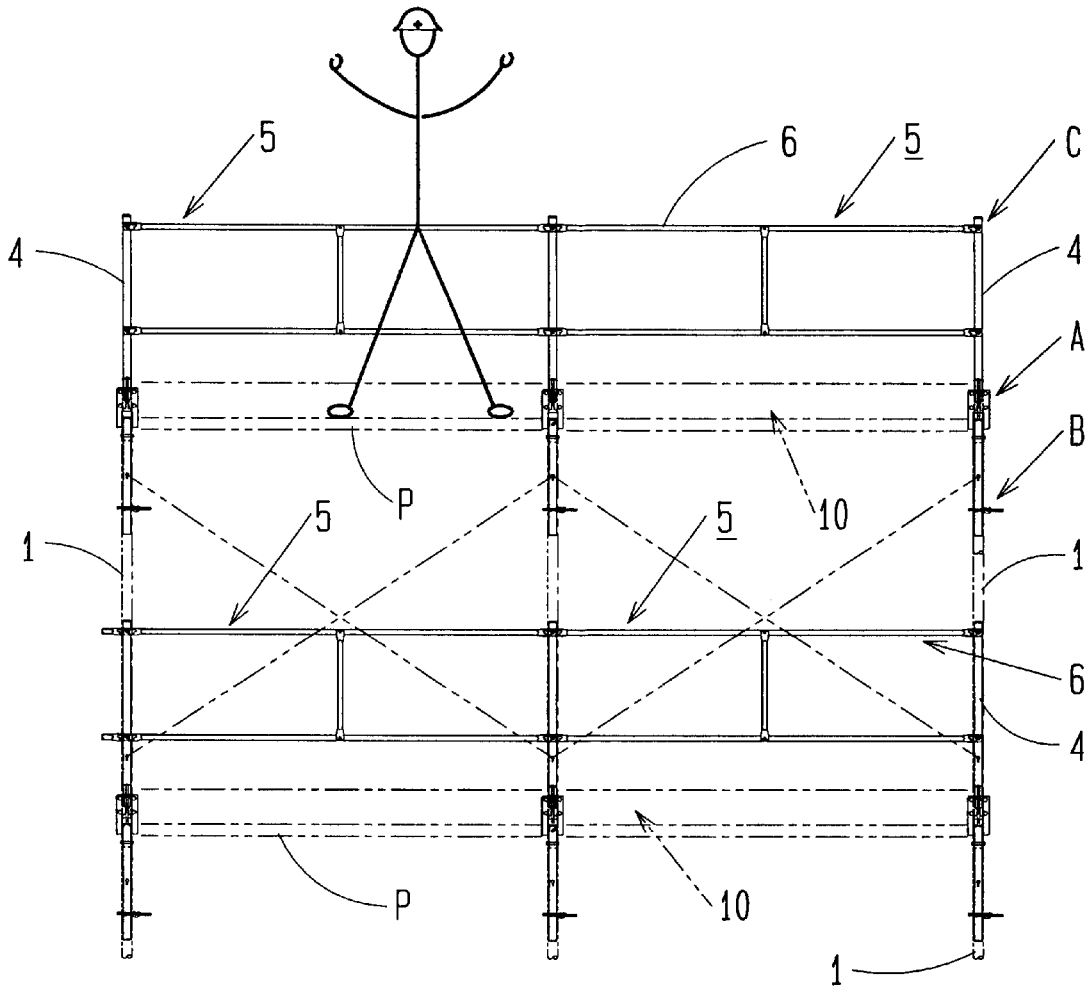
FIG. 8 is a front view of the frame scaffolding showing the mounting steps of the handrail.

Next, as shown in FIG. 4, on the scaffolding plate P of the lower stage, the right side of the handrail frame 6 is connected to the other longitudinal strut 4 through the stop pin 16 and the slot 15, further as shown in FIGS. 5 and 6 the handrail frame 6 is rotated about the stop pin 16 on the left side to raise it upward holding the longitudinal strut 4 on the right side, and then the longitudinal strut 4 on the right side is secured to the fittings 1 through the first and second mounting members A and B. Further, as shown in FIG. 7, on the lower scaffolding plate P, the scaffolding plate P of the upper stage is raised, and the scaffolding plate P is slipped and mounted on the lateral member 2. While in FIG. 7, the vertically assembled frame scaffolding is constituted, the scaffolding frames 8 are assembled vertically as well as laterally in the same method as that described above to enable constituting a large frame scaffolding shown in FIG. 8.

Where the handrail 5 is mounted as described above, since the longitudinal strut 4 and the handrail frame 6 are separated from each other, they can be assembled sequentially independently one by one, which is light in weight, and easy in carrying, and which improves workability. Further, the longitudinal strut 4 and the handrail frame 6 are changed in direction simply even if the space between the fittings 1, 1 is narrow, and mounting work can be carried out without receiving the control of the working space.

Figure 17:
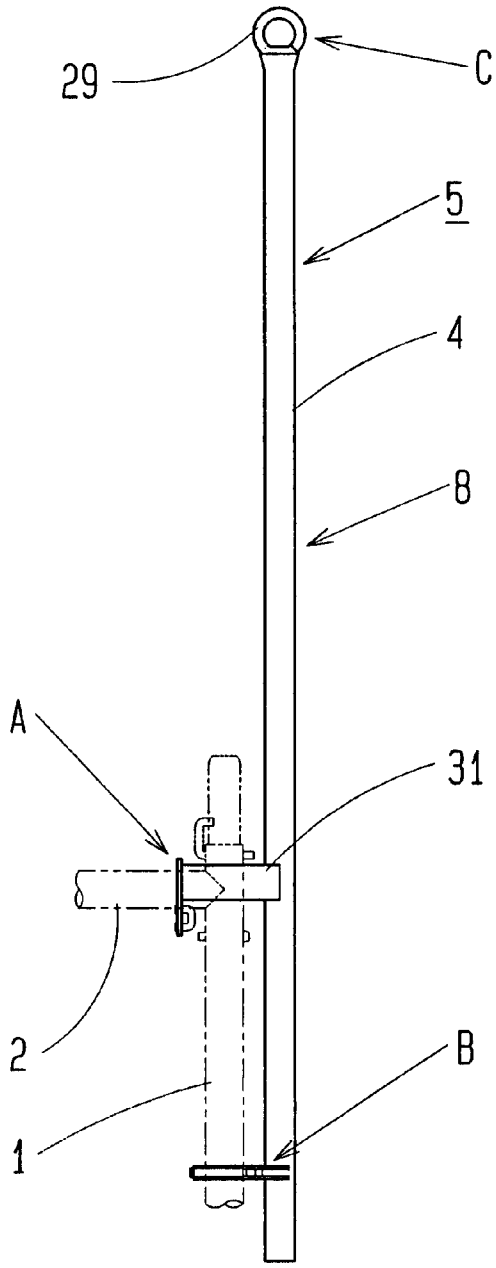
FIG. 17 is a schematic side view of a handrail according to another embodiment.
Figure 20:
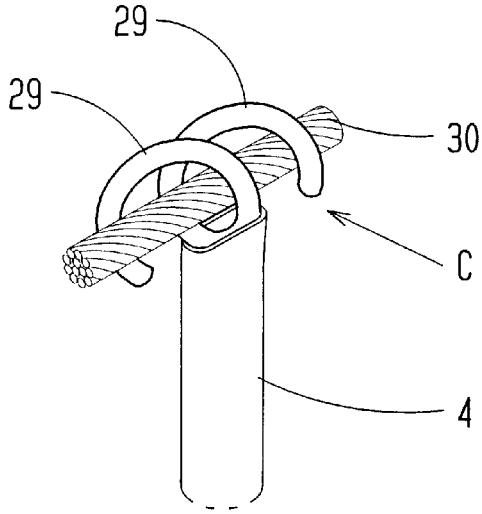
FIG. 20 is likewise an enlarged perspective view of a third mounting member.
Figure 21:
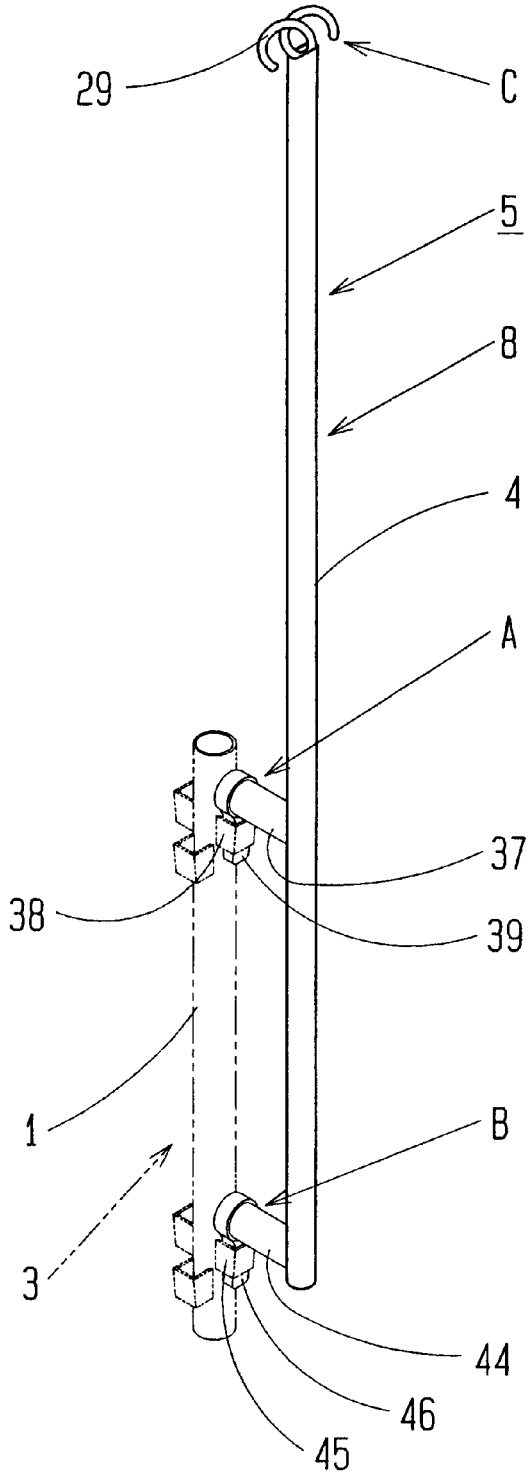
FIG. 21 is a perspective view of a handrail according to another embodiment.

Next, the mounting method for the handrail according to the second pattern will be explained. The frame scaffolding having the handrail frame mounted in the method of the second pattern shown in FIGS. 17, 20 and 21 is the same as the case of FIG. 1 in that the scaffolding frame 8 comprises the frame 3, the handrail 5 and the scaffolding plate P, but the handrail frame constituting the handrail 5 is constituted as a main rope 30 shown in FIG. 20. And, the first, second and third mounting members for mounting these handrails 5 are changed. The mounting method for the handrail according to the second pattern is described in claim 2.

Figure 18:
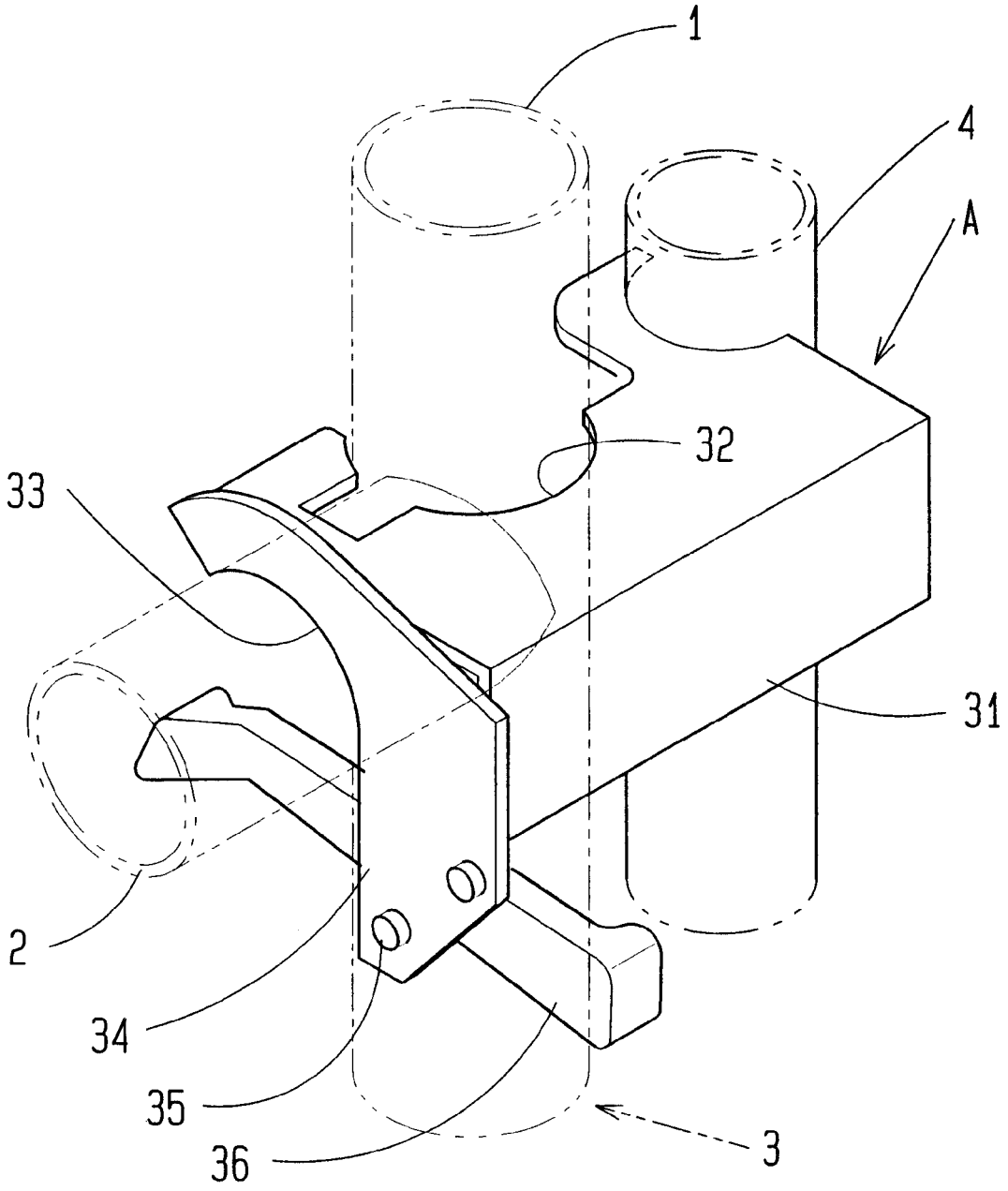
FIG. 18 is an enlarged perspective view of a first mounting member in the handrail of FIG. 17.

The first mounting member A used for the handrail 5 shown in FIG. 17 comprises, as shown in FIGS. 17 and 18, a support plate 31 connected laterally to the longitudinal strut 4, a holding groove 32 formed on the side of the support plate 31 and engaged with the outer surface of the fittings 1, a stop plate 34 connected to the outer end of the support plate 31 and having an engaging groove 33 engaged with the upper surface of the lateral member 2, a guide 35 provided on the stop plate 34, and a wedge 36 inserted into the guide 35 and opposed to the engaging groove 33. Thereby, the holding groove 32 is fitted in the outer surface of the fittings 1, the lateral member 2 is held by the engaging groove 33 and the wedge 36 from top and bottom, and the longitudinal strut 4 is connected to the frame 3 through the support plate 31.

Likewise, the first mounting member A used for the handrail 5 shown in FIG. 21 comprises a support rod 37 connected laterally to the intermediary of the longitudinal strut 4, and a hook 39 provided downward to the end of the support rod 37 and fitted in a socket 38 on the side of the fittings 1. The hook 39 is fitted in the socket 38 to thereby stand the longitudinal strut 4 of the handrail 5 along the fittings 1.

Figure 19:
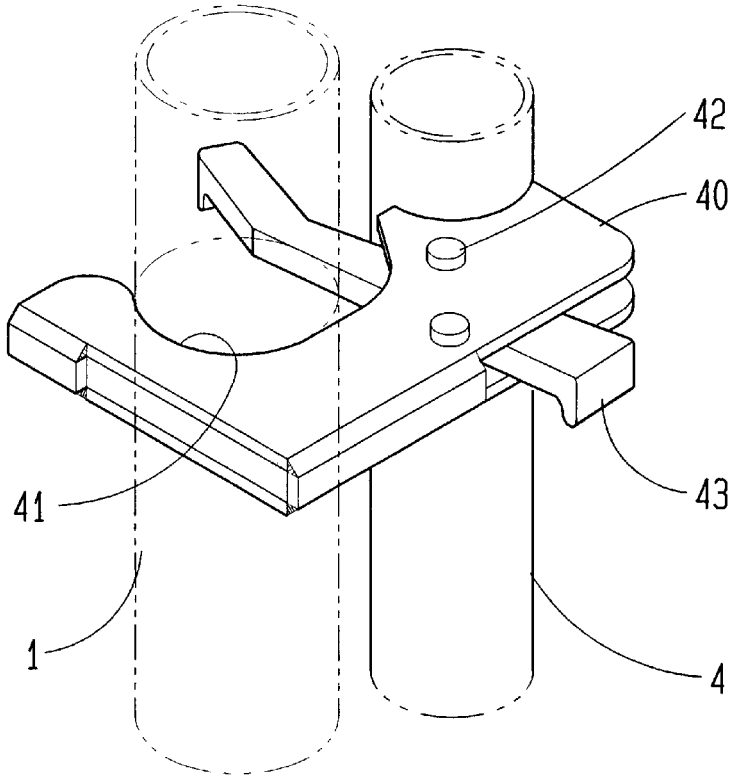
FIG. 19 is likewise an enlarged perspective view of a second mounting member.

Further, the second mounting member B used for the handrail 5 shown in FIG. 17 comprises, as shown in FIG. 19, a plate-like bracket 40 mounted laterally to the longitudinal strut 4, a holding groove 41 formed on the outer surface of the bracket 40 and engaged with the outer surface of the fittings 1, a guide 42 provided on the outer end of the bracket 40, and a wedge 43 inserted into the guide 42 and opposed to the holding groove 41. Thereby, the fittings 1 is held by the holding groove 41 and the wedge 43, and the strut 4 is held through the bracket 40 to thereby prevent the longitudinal strut 4 from being fallen down and occurrence of a rattle.

Likewise, the second mounting member B used for the handrail 5 shown in FIG. 21 comprises a support rod 44 connected laterally to the lower part of the strut, and a hook 46 provided downward to the lower part of the support rod 44 and fitted in a socket 45 on the side of the fittings 1. And, the hook 46 is fitted into the socket 45 to thereby prevent the longitudinal strut 4 from being fallen down and occurrence of a rattle.

Likewise, the third mounting member C used for the handrail 5 shown in FIGS. 17 and 21 comprises a ring or a semicircular abutment ring 29 provided on the upper end of the longitudinal strut 4 and inserting a main rope 30 comprising a rope constituting the handrail frame 6.

Figure 22:
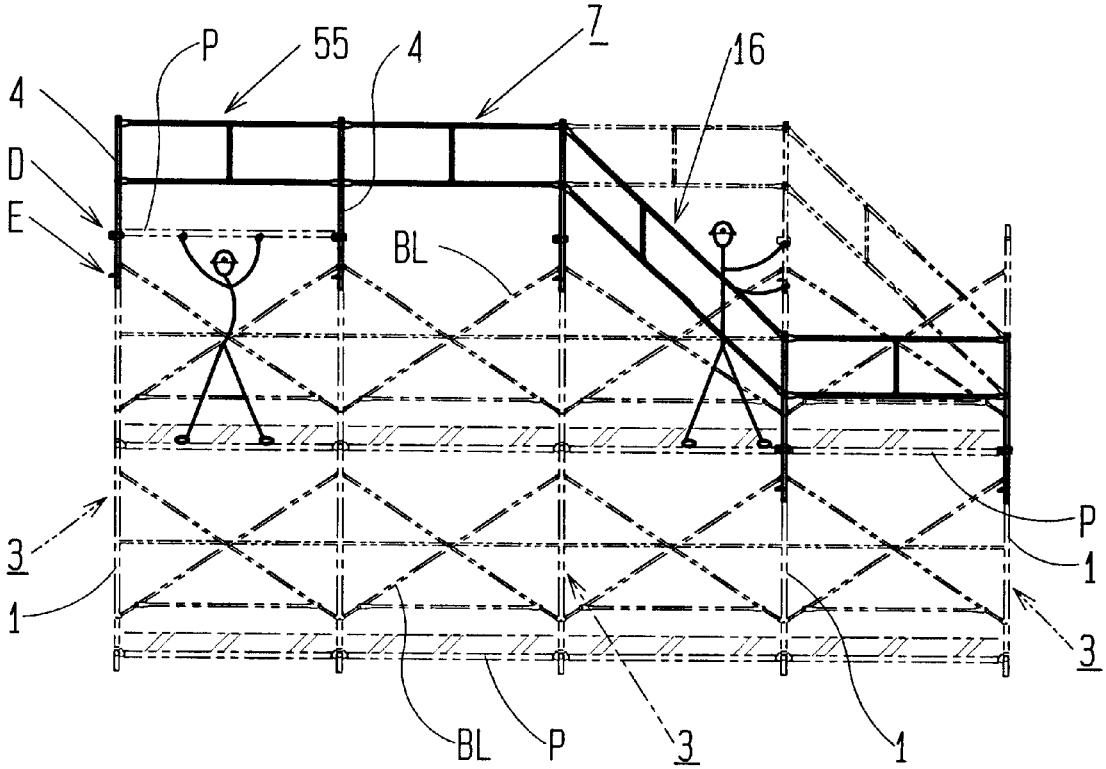
FIG. 22 is a front view of a frame scaffolding in the state that a handrail is mounted.
Figure 23:
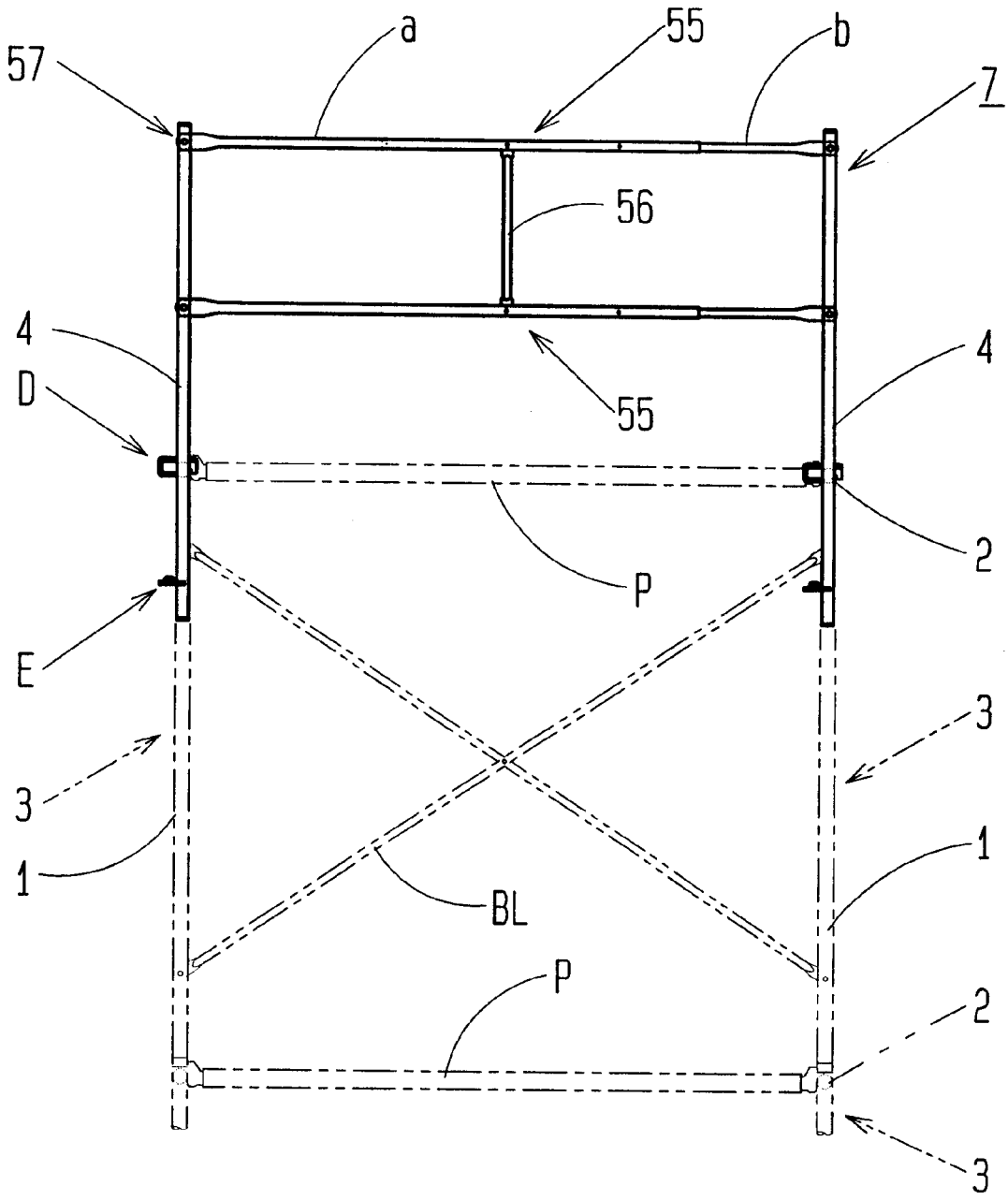
FIG. 23 is a partly enlarged front view of FIG. 22.
Figure 24:
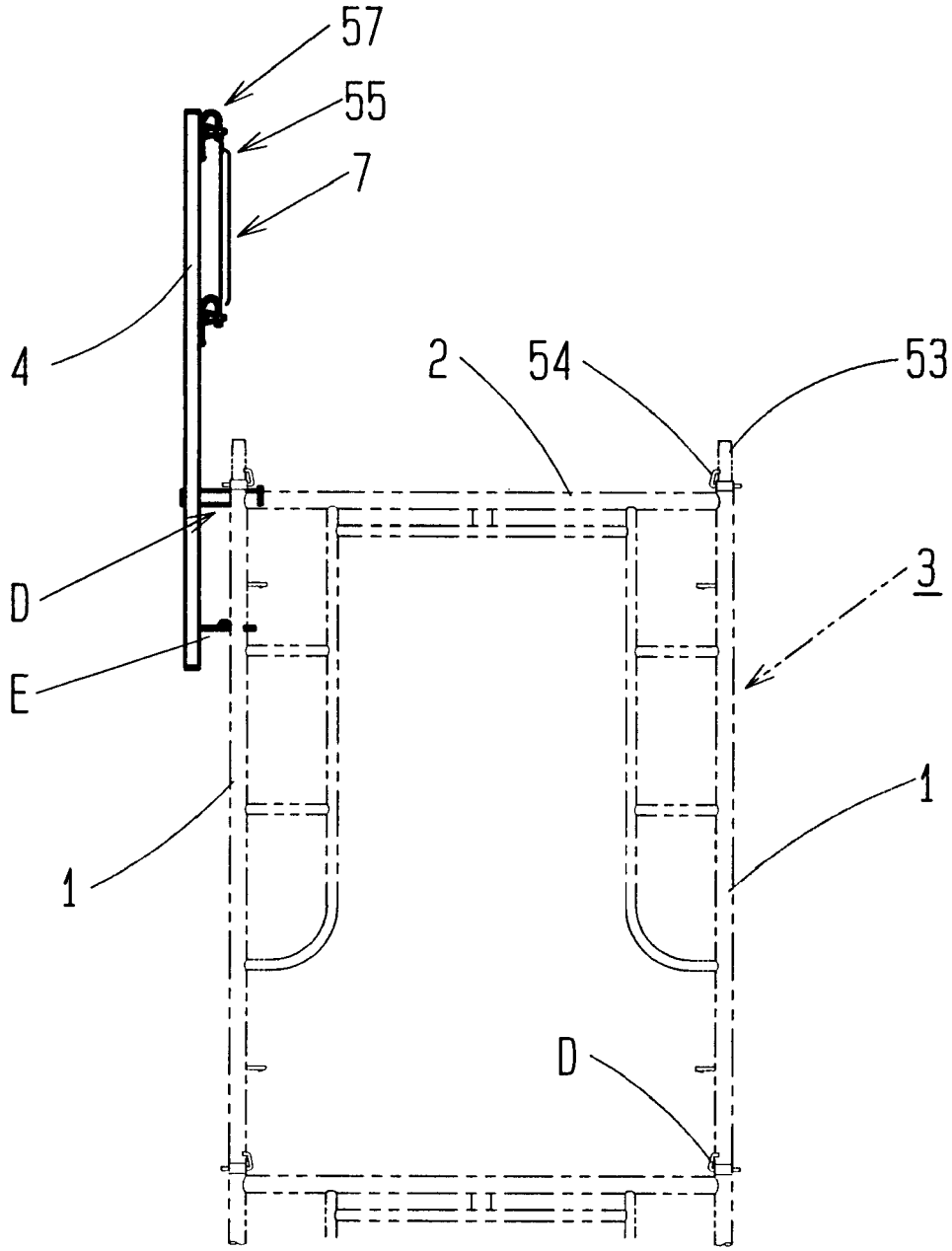
FIG. 24 is an enlarged side view of FIG. 23.

Next, the mounting method for the handrail according to the third pattern will be explained. This method is a mounting method for a handrail for mounting a handrail 7 on a frame 3 comprising fittings 1 and a lateral member 2 connected to the fittings 1, as shown in FIGS. 22, 23, and 24. That is, the mounting method for the handrail according to this pattern is described in claim 3.

The handrail 7 is mounted as an advance handrail that can be replaced on the uppermost portion of the frame 3, as shown in FIG. 24, but after being mounted on the frame 3, it can be used as a fixed handrail without modification.

Where the handrail 7 is used as the advance handrail, an operator mounts the handrail 7 on the scaffolding plate P erected on the lateral member 2 in the frame 3 of the lower stage, as shown in FIG. 24.

Next, the upper scaffolding plate P is erected on the upper lateral member 2, the frame 3 of the upper stage is mounted while planning safety by the handrail 7 on the scaffolding plate P, and a brace BL or the like is installed on the frame 3, and at the same time, the other fixed handrail is mounted.

Upon completion of this operation, the handrail 7 is removed, and this handrail 7 is further mounted on the frame 3 on the upper stage side again on the upper scaffolding plate P. That is, the handrails 7 are replaced upward and used one after another. Where the upper frame 3 (not shown) is connected to the lower frame 3, this is done by connecting the upper and lower fittings 1, 1 together.

Figure 27:
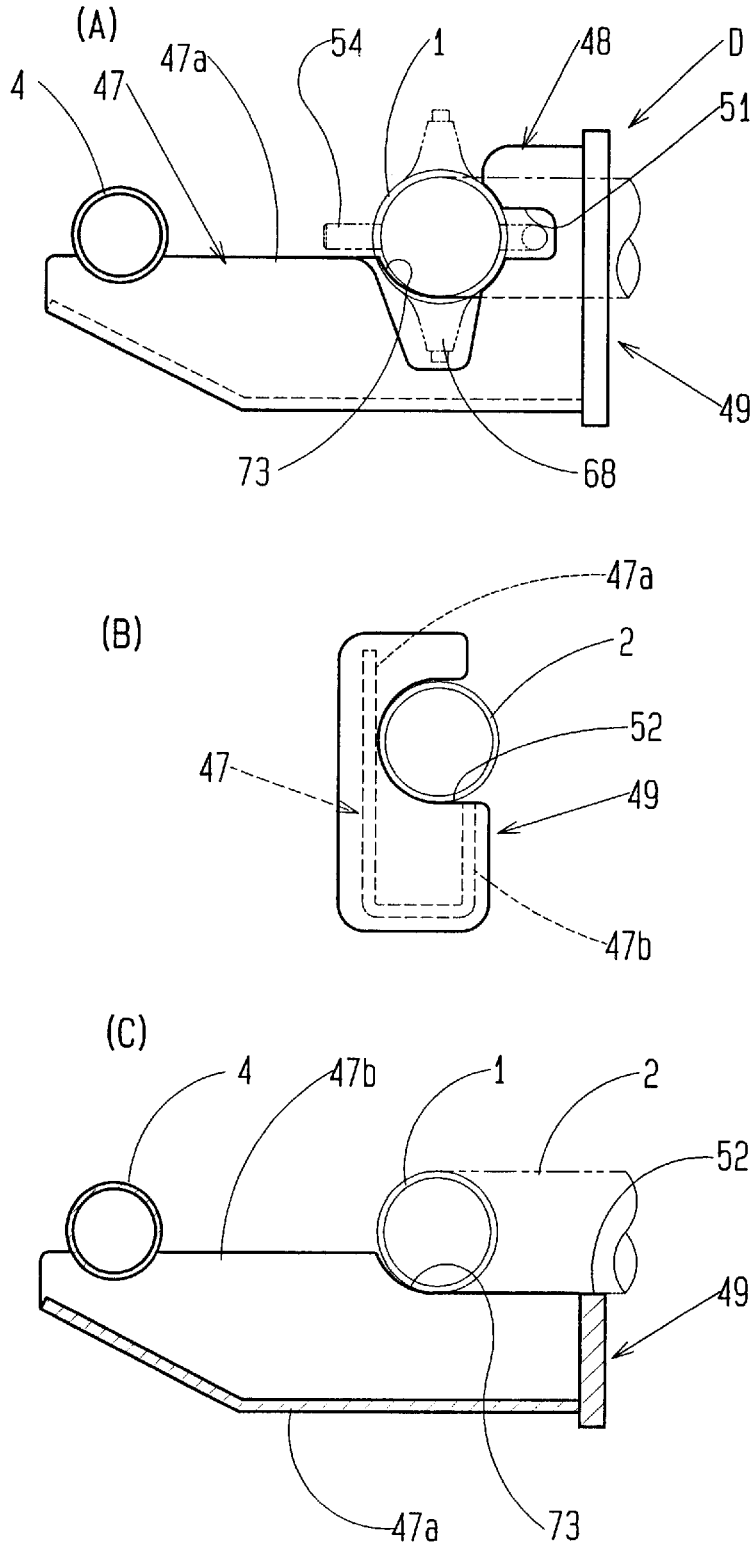
FIG. 27 (A) is a plan view of the bracket.

In this case, as shown in FIGS. 24 and 27, a spacer 53 and a stop 54 or 68 are provided at the upper part of the lower fittings 1, and the upper fittings 1 is inserted into the spacer 53, after which the spacer 53 is connected to the upper fittings 1 through the stop 54 or 68 to plan the slip-out resistance.

The stop 54 comprises a pin biased by a spring, and the other stop 68 is of a rotational type provided with a handle.

With respect to these stops 54, 68, various types of them are used according to makers, but when the advance handrail is mounted on the frame 3 as described above, it interferes in these stops 54, 68, sometimes failing to mount the handrail, whereas the handrail 7 of the present invention can be mounted without interfering in the stop 54 or the like, or it can be removed and replaced upward.

The mounting method for the handrail according to the present invention will be further explained hereinafter. The first and second mounting devices used for the mounting method for the handrail of the present invention comprises brackets D, E.

Figure 26:
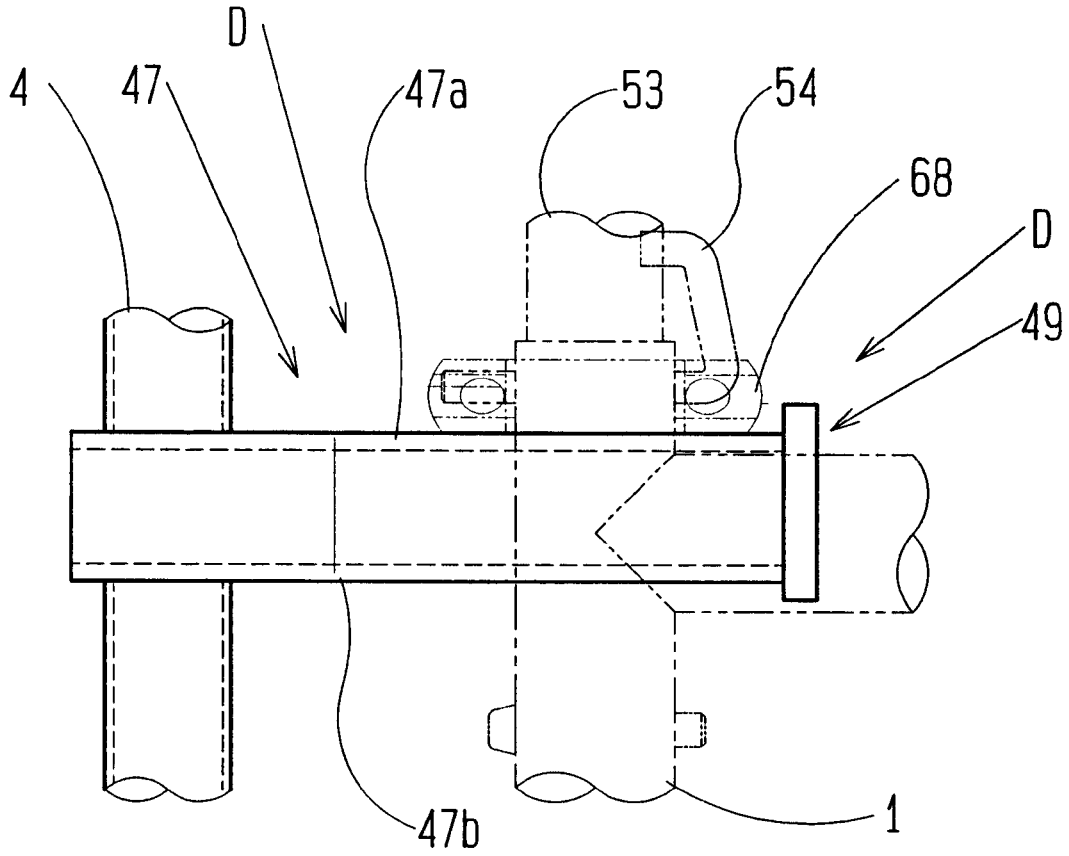
FIG. 26 is an enlarged side view of a bracket.

The bracket D comprises, as shown in FIGS. 26 and 27 (A) (B) (C), a horizontal frame body 47 having an end connected to the strut, a support frame 48 joined at right angle from the frame body 47, and a stop frame 49 joined vertically with the outer end of the frame body 47 and the outer end of the support frame 48.

Further, in the vicinity of a corner portion where the frame body 47 crosses the support frame 48, the frame body 47 and the support frame 48 are formed with groove-like cuts 50, 51, respectively, opened outward in the short direction, and a curved stop groove 52 is provided at the lower part of the stop frame 49.

The frame body 47 and the support frame 48 may be formed by a single plate. However, in the present embodiment, as shown in FIG. 27, the frame body 47 and the support frame 48 have a horizontal integral upper plate 47*a* joined therewith, groove-like cuts 50, 51 opened outward are provided in the upper plate 47*a*, and a lower plate 47*b* is formed with a curved support surface opened outward.

As shown in FIG. 23, the handrail 7 comprises a pair of longitudinal struts 4, 4, parallel expansible handrail frames 55, 55 erected laterally at the upper parts of the struts 4, 4, a connecting member 56 rotatably erected between the handrail frames 55, 55, an intermediate bracket D provided on the strut 4, and a bracket E provided at the lower part of the strut 4.

Figure 30:
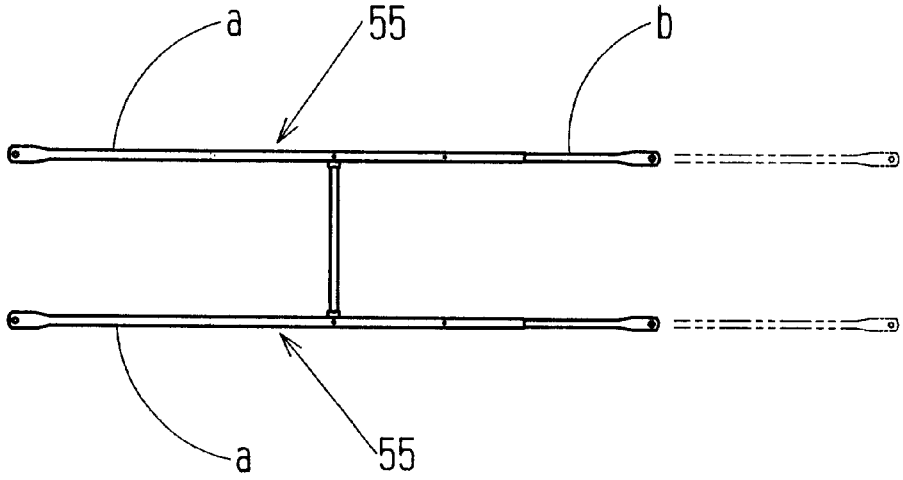
FIG. 30 is a front view of the handrail.
Figure 31:
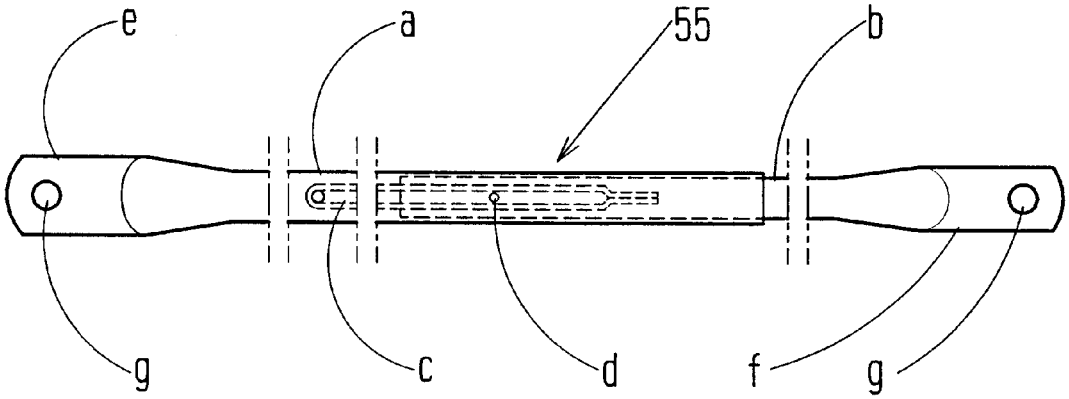
FIG. 31 is a partly enlarged front view of FIG. 30.

The handrail frame 55 comprises, as shown in FIGS. 30 and 31, an outer tube a, and an inner tube b expandably inserted into the outer tube a, and a pin d provided on the inner tube b is movably inserted into a slip-out resisting hole c formed in the outer tube a.

At ends of the outer tube a and the inner tube b are provided flat mounting pieces e, f and mounting holes g, g formed in the mounting pieces e, f.

Figure 29:
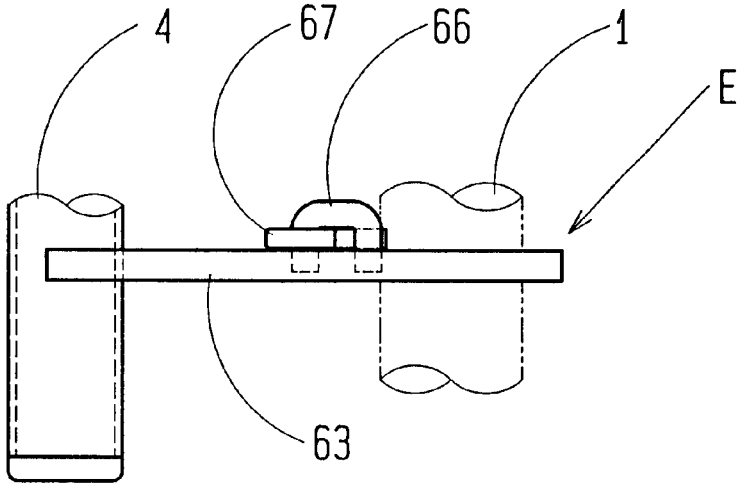
FIG. 29 is a side view of FIG. 7.

The handrail frame 55 is detachably connected to the strut 4 through a mounting hardware 57 shown in FIGS. 24 and 29.

Figure 25:
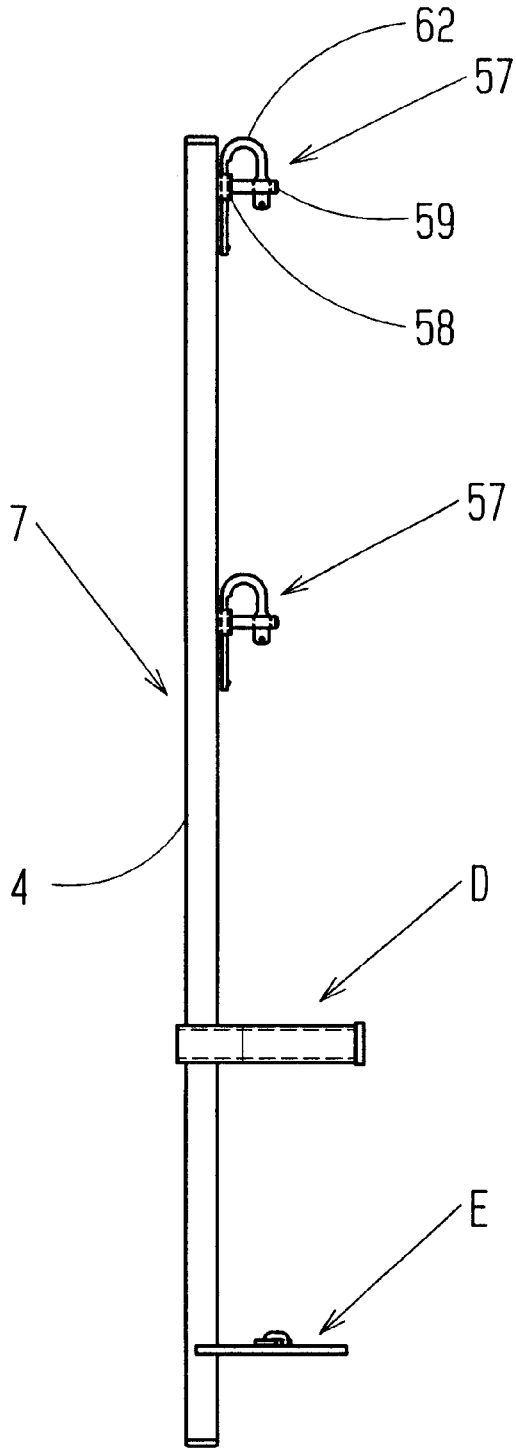
FIG. 25 is an enlarged side view of the handrail.
Figure 32:
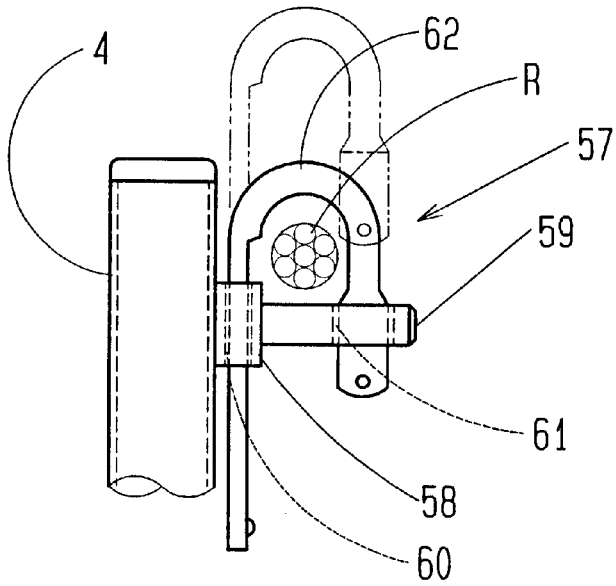
FIG. 32 is an enlarged side view of a mounting hardware for a handrail.

The mounting hardware 57 comprises, as shown in FIGS. 25 and 32, a longitudinal tubular guide 58 provided on the strut 4, a guide rod 59 projecting horizontally from the tubular guide 58, and a stop pin 62 vertically movably inserted into holes 60, 61 formed vertically in the tubular guide 58 and the guide rod 59.

In the rail frame 55, in the state that the stop pin 62 is raised, mounting holes g on both ends thereof are put into the guide rod 59, and then the stop pin 62 is lowered and inserted into the hole 24.

Thereby, the handrail frame 18 is prevented from being slipped-out by the stop pin 62 while being put into the guide rod 59.

Figure 33:
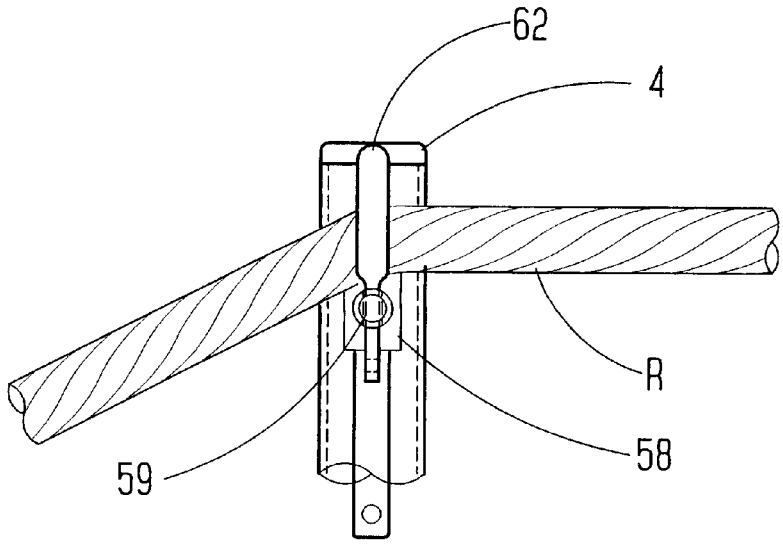
FIG. 33 is a front view of FIG. 32.

As shown in FIGS. 32 and 33, a rope R used as a main rope or other handrail frames may be inserted into the mounting hardware 57.

Figure 28:
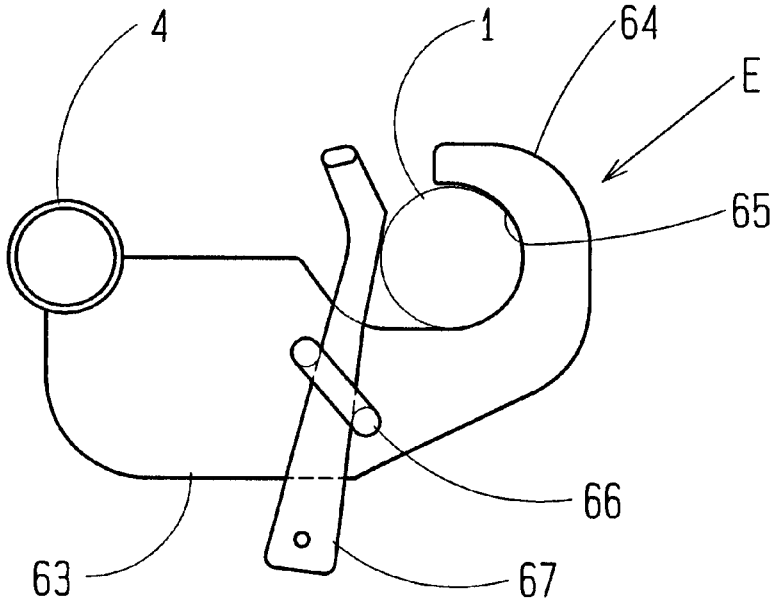
FIG. 28 is an enlarged plan view of the bracket.

Further, the bracket E provided at the lower part of the strut 4 comprises, as shown in FIGS. 28 and 29, a support piece 63 having an end secured to the strut 4, a hook 64 integrally joined with the support piece 63, a holding groove 65 formed in the hook 64, a guide 66 provided on the support piece 63, and a wedge 67 inserted into the guide 66.

The hook 64 is slipped on the fittings 1 through the holding groove 65, the wedge 67 is hammered so that the fittings 1 is held by the holding groove 65 and the wedge 67, and the lower part of the strut 4 is held by the bracket E.

Next, the step for detachably mounting the handrail 7 on the frame 3 will be explained hereinafter. As already described, first, on the lower scaffolding plate P, the strut 4 is mounted on the crossing portion between the fittings 1 and the lateral member 2 through the bracket D.

In this case, the frame body 47, the support frame 48 and the stop frame 49 are moved close to the fittings 1 and the lateral member 2 while inclining them laterally of the fittings 1, and then the stop frame 49 is brought into engagement with the lateral member 2 through the stop groove 52 while raising the frame body 47 in the horizontal direction to make the whole bracket D horizontal.

At this time, even if the stop 54 or 68 is present on the fittings 1, the frame body 47 and the support frame 48 are bent at right angles into an L-shape, and therefore, even when they are inclined close thereto, these frame body 47 and support frame 48 are free from interference in the stop 54 or 68.

Further, when the frame body 47 and the support frame 48 are raised horizontally while engaging the stop frame 49 with the lateral member 2, the pin-like stop 54 or the handle type stop 68 is moved into the groove-like cuts 50, 51 opened outward to prevent it from interfering with the frame body 47 and the support frame 48.

After the strut 4 has been connected through the bracket D as described above, the lower bracket E is connected to the fittings 1 whereby the strut 4 is fixed. It is noted that in the above case, a support surface 73 of the lower side plate 47*b* engages the outer surface of the fittings 1.

As described above, the handrail frame 55 is mounted after the strut 4 is stood to arrange the handrail 7 upward, and the upper frame 3 is mounted while planning safety make use of the handrail 7. Thus mounting operation of a brace or the like is carried out.

Further, after mounting operation of the upper frame 3 has been completed, the handrail frame 55 is removed, the strut 4 is removed in the step reversed to the order as described above, and again the strut 4 is replaced upward to utilize it as an advance handrail.

The above strut 4 is utilized not only as the handrail but also as the main rope strut alone, which construction is the same as that mentioned above.

Figure 34:
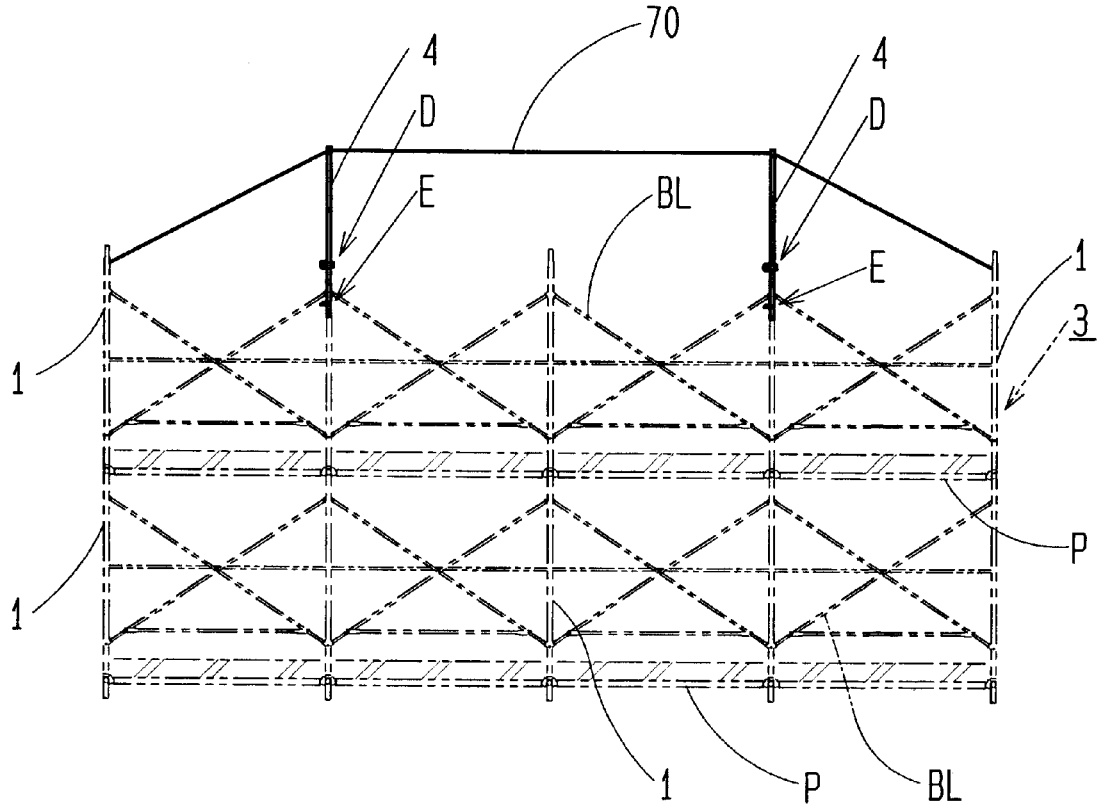
FIG. 34 is a front view of a frame scaffolding according to another embodiment.
Figure 35:
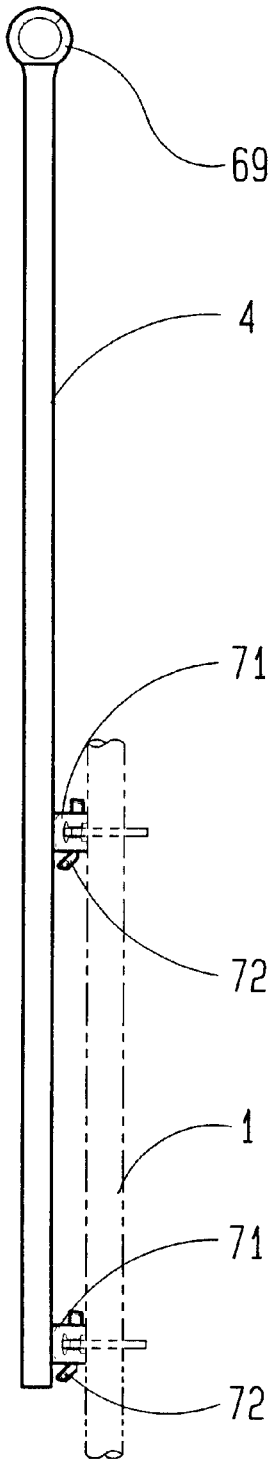
FIG. 35 is a side view of a strut for a handrail according to another embodiment.
Figure 36:
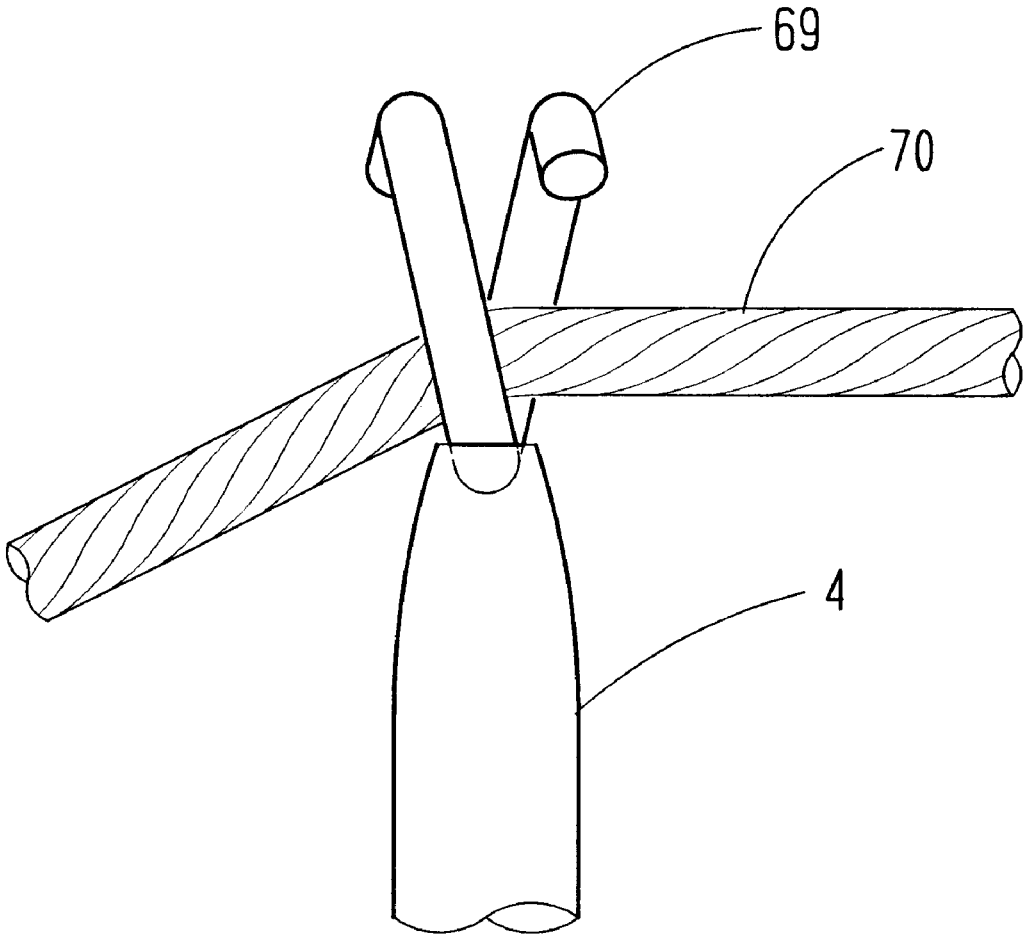
FIG. 36 is a partly enlarged front view of FIG. 34.

That is, as shown in FIGS. 34 and 35, a stop ring 69 is provided on the upper end of the strut 4, a rope 70 as a main rope is inserted into the stop ring 69, and simultaneously when the strut 4 is raised, the rope 70 is erected between the struts 4, in the same manner as described above.

The strut 4 may be mounted on the fittings 1 through a mounting device comprising a shoe 71 and a wedge 72 as shown in FIG. 35.

According to the present invention, there are the following effects.

(1) According to the inventions of Claims, the frame, the handrail and the scaffolding plate of the upper stage can be installed in advance on the scaffolding plate of the lower stage. Therefore, when the upper frame, the scaffolding plate, the brace and the like are further installed on the scaffolding plate of the upper stage, the handrail is to be an advance handrail, and safety of various works on the scaffolding plate of the upper stage can be secured by the advance handrail. That is, the handrail installed on the scaffolding plate of the lower stage is to be installed on the scaffolding plate side of the upper stage without fail, and various works on the scaffolding plate of the upper stage can be carried out safely. Further, the handrail can be removed on the scaffolding plate of the lower stage by the step reversed to the mounting step for the handrail.

(2) According to the invention of claim 1, since the handrail is constituted independently in the strut and the handrail frame, the strut can be mounted on the frame independently, and the handrail frame can be mounted on the strut later. At this time, since the strut and the handrail frame are independent to reduce the weight, mounting and removing work thereof are easy to quicken the work.

(3) Likewise, in carrying and storing, they can be performed independently, thus not being bulky, capable of storing compactly, and not being placed under restriction in installing space. Likewise, even in a narrow space, the direction can be changed freely, and even the spacing between the fittings is narrow, the handrail frame can be mounted on the longitudinal strut simply.

(4) According to the inventions of claims 2 and 3, by merely raising the longitudinal struts one by one, the handrail frame is raised following that, thus allowing the mounting work of the handrail speed-up easily.

(5) Likewise, when one strut is raised, the weight is light as compared with the whole weight of the handrail, thus making the detaching work easy, and a burden on an operator is reduced.

(6) Likewise, since the handrail frame is expandable, even if the space between the fittings is narrow, the whole handrail can be erected between the fittings while doing a positioning without being placed under restriction in space.

What is claimed is:

1. A mounting method for a handrail in a frame scaffolding in which a plurality of frames comprising a plurality of fittings and a lateral member are spaced laterally apart, a scaffolding plate is erected between respective frames a handrail is erected between the respective fittings adjacent to each other laterally to constitute a scaffolding frame, and a plurality of the scaffolding frames are assembled vertically, the handrail comprising a pair of longitudinal struts opposed laterally, and a lateral handrail frame erected between the struts, the struts including a first mounting member mounted on the lateral member or one of the fittings, a second mounting member mounted on one of the fittings, and a third mounting member for receiving wend of the handrail frame, the method comprising the steps of:

mounting one of the struts on an upper end of one of the fittings within the first and second mounting members on the scaffolding plate of a lower stage;

mounting one end of the handrail frame to said one of the struts by means of the third mounting member on the scaffolding plate of the lower stage;

mounting the other of the struts to the other end of the handrail frame by means of the third mounting member on the scaffolding plate of the lower stage;

raising the other of the struts while rotating the other end upward about one end of the handrail frame on the scaffolding plate of the lower stage; and mounting the other of the struts to an upper end of another of the fittings within both the first and second mounting members on the scaffolding plate of the lower stage.

2. A mounting method for a handrail in a frame scaffolding in which a plurality of frames comprising a plurality of fittings and a lateral member are spaced laterally apart, a scaffolding plate is erected between respective frames, a handrail is erected between the respective fittings adjacent to each other laterally to constitute a scaffolding frame, and a plurality of the scaffolding frames are assembled vertically, the handrail comprising a pair of longitudinal struts opposed laterally, and a lateral main rope erected between the struts, the struts including a first mounting member mounted an the lateral member or one of the fittings, a second mounting member mounted on one of the fittings and a main rope mourning member for mounting the main rope, the method comprising the steps of:

inserting the main rope into a main rope mounting portion of an upper end of the strut on the scaffolding plate of a lower stage;

mounting one strut on an upper end of one of the fittings within both the first and second mounting members on the scaffolding plate of the lower stage; and mounting the other strut on an upper end of the other fittings within both the first and second mourning members on the scaffolding plate of the lower stage.

3. A mounting method for a handrail in a frame scaffolding, in which a plurality of frames comprising a plurality of fittings and a lateral member are spaced laterally apart, a scaffolding plate is erected between the respective frames, a handrail is erected between the respective fittings adjacent to each other laterally to constitute a scaffolding frame, and a plurality of the scaffolding frames are assembled vertically, the handrail comprising a pair of longitudinal struts opposed laterally, an expansible lateral handrail frame rotatably erected between the struts, and an upper and lower pair of first and second mounting members provided downwardly of the struts, the method comprising the steps of:

raising one of the struts while extending the handrail frame on the scaffolding plate of a lower stage;

mounting the one of the struts to one of the fittings within both the first and second mounting members;

raising the other of the struts while shortening the handrail frame on the scaffolding plate of the lower stage; and mounting the other of the struts on the other of the fittings within both the first and second mounting members.

* * * * *